US007706543B2

(12) United States Patent
Daniel

(10) Patent No.: US 7,706,543 B2
(45) Date of Patent: Apr. 27, 2010

(54) METHOD FOR PROCESSING AUDIO DATA AND SOUND ACQUISITION DEVICE IMPLEMENTING THIS METHOD

(75) Inventor: Jérôme Daniel, Penvenan (FR)

(73) Assignee: France Telecom, Paris (FR)

( * ) Notice: Subject to any disclaimer, the term of this patent is extended or adjusted under 35 U.S.C. 154(b) by 1379 days.

(21) Appl. No.: 10/535,524

(22) PCT Filed: Nov. 13, 2003

(86) PCT No.: PCT/FR03/03367

§ 371 (c)(1),
(2), (4) Date: May 18, 2005

(87) PCT Pub. No.: WO2004/049299

PCT Pub. Date: Jun. 10, 2004

(65) Prior Publication Data

US 2006/0045275 A1 Mar. 2, 2006

(30) Foreign Application Priority Data

Nov. 19, 2002 (FR) ..... 02 14444

(51) Int. Cl.
*H04R 5/00* (2006.01)
*H04R 5/02* (2006.01)

(52) U.S. Cl. ..... 381/17; 381/18; 381/19; 381/26; 381/307

(58) Field of Classification Search ..... 381/17–19, 381/309–310, 307, 26
See application file for complete search history.

(56) References Cited

U.S. PATENT DOCUMENTS

| | | | | |
|---|---|---|---|---|
| 4,219,696 | A | 8/1980 | Kogure et al. | |
| 4,731,848 | A | 3/1988 | Kendall et al. | |
| 5,452,360 | A | 9/1995 | Yamashita et al. | |
| 5,771,294 | A | 6/1998 | Inoue et al. | |
| 6,154,553 | A | 11/2000 | Taylor | |
| 7,167,567 | B1 * | 1/2007 | Sibbald et al. | 381/17 |
| 7,231,054 | B1 * | 6/2007 | Jot et al. | 381/310 |
| 2001/0040969 | A1 * | 11/2001 | Revit et al. | 381/60 |

OTHER PUBLICATIONS

Chen et al., "Synthesis of 3D Virtual Auditory Space Via a Spatial Feature Extraction and Regularization Model," Proceedings of the Virtual Reality Annual International Symposium, Seattle, Sep. 18-22, 1993, IEEE, vol. SYMP. 1, pp. 188-193, New York, US (Sep. 18, 1993).

* cited by examiner

*Primary Examiner*—Xu Mei
*Assistant Examiner*—George C Monikang
(74) *Attorney, Agent, or Firm*—Drinker Biddle & Reath LLP

(57) ABSTRACT

The invention concerns the processing of audio data. The invention is characterized in that it consists in: (a) encoding signals representing a sound propagated in three-dimensional space and derived from a source located at a first distance (P) from a reference point, to obtain a representation of the sound through components expressed in a spherical harmonic base, of origin corresponding to said reference point, (b) and applying to said components compensation of a near-field effect through filtering based on a second distance (R) defining, for sound reproduction, a distance between a reproduction point ($HP_i$), and a point (P) of auditory perception where a listener is usually located.

26 Claims, 11 Drawing Sheets

METHOD FOR PROCESSING AUDIO DATA AND SOUND ACQUISITION DEVICE IMPLEMENTING THIS METHOD

CROSS-REFERENCE TO RELATED APPLICATIONS

This application is the U.S. national phase of the PCT/FR2003/003367 filed Nov. 13, 2003, which claims the benefit of French Application No. 02 14444 filed Nov. 19, 2002, the entire content of which is incorporated herein by reference.

FIELD OF INVENTION

The present invention relates to the processing of audio data.

BACKGROUND OF THE INVENTION

Techniques pertaining to the propagation of a sound wave in three-dimensional space, involving in particular specialized sound simulation and/or playback, implement audio signal processing methods applied to the simulation of acoustic and psycho-acoustic phenomena. Such processing methods provide for a spatial encoding of the acoustic field, its transmission and its spatialized reproduction on a set of loudspeakers or on headphones of a stereophonic headset.

Among the techniques of spatialized sound are distinguished two categories of processing that are mutually complementary but which are both generally implemented within one and the same system.

On the one hand, a first category of processing relates to methods for synthesizing a room effect, or more generally surrounding effects. From a description of one or more sound sources (signal emitted, position, orientation, directivity, or the like) and based on a room effect model (involving a room geometry, or else a desired acoustic perception), one calculates and describes a set of elementary acoustic phenomena (direct, reflected or diffracted waves), or else a macroscopic acoustic phenomenon (reverberated and diffuse field), making it possible to convey the spatial effect at the level of a listener situated at a chosen point of auditory perception, in three-dimensional space. One then calculates a set of signals typically associated with the reflections ("secondary" sources, active through re-emission of a main wave received, having a spatial position attribute) and/or associated with a late reverberation (decorrelated signals for a diffuse field).

On the other hand, a second category of methods relates to the positional or directional rendition of sound sources. These methods are applied to signals determined by a method of the first category described above (involving primary and secondary sources) as a function of the spatial description (position of the source) which is associated with them. In particular, such methods according to this second category make it possible to obtain signals to be disseminated on loudspeakers or headphones, so as ultimately to give a listener the auditory impression of sound sources stationed at predetermined respective positions around the listener. The methods according to this second category are dubbed "creators of three-dimensional sound images", on account of the distribution in three-dimensional space of the awareness of the position of the sources by a listener. Methods according to the second category generally comprise a first step of spatial encoding of the elementary acoustic events which produces a representation of the sound field in three-dimensional space. In a second step, this representation is transmitted or stored for subsequent use. In a third step, of decoding, the decoded signals are delivered on loudspeakers or headphones of a playback device.

The present invention is encompassed rather within the second aforesaid category. It relates in particular to the spatial encoding of sound sources and a specification of the three-dimensional sound representation of these sources. It applies equally well to an encoding of "virtual" sound sources (applications where sound sources are simulated such as games, a spatialized conference, or the like), as to an "acoustic" encoding of a natural sound field, during sound capture by one or more three-dimensional arrays of microphones.

Among the conceivable techniques of sound spatialization, the "ambisonic" approach is preferred. Ambisonic encoding, which will be described in detail further on, consists in representing signals pertaining to one or more sound waves in a base of spherical harmonics (in spherical coordinates involving in particular an angle of elevation and an azimuthal angle, characterizing a direction of the sound or sounds). The components representing these signals and expressed in this base of spherical harmonics are also dependent, in respect of the waves emitted in the near field, on a distance between the sound source emitting this field and a point corresponding to the origin of the base of spherical harmonics. More particularly, this dependence on the distance is expressed as a function of the sound frequency, as will be seen further on.

This ambisonic approach offers a large number of possible functionalities, in particular in terms of simulation of virtual sources, and, in a general manner, exhibits the following advantages:

- it conveys, in a rational manner, the reality of the acoustic phenomena and affords realistic, convincing and immersive spatial auditory rendition;
- the representation of the acoustic phenomena is scalable: it offers a spatial resolution which may be adapted to various situations. Specifically, this representation may be transmitted and utilized as a function of throughput constraints during the transmission of the encoded signals and/or of limitations of the playback device;
- the ambisonic representation is flexible and it is possible to simulate a rotation of the sound field, or else, on playback, to adapt the decoding of the ambisonic signals to any playback device, of diverse geometries.

In the known ambisonic approach, the encoding of the virtual sources is essentially directional. The encoding functions amount to calculating gains which depend on the incidence of the sound wave expressed by the spherical harmonic functions which depend on the angle of elevation and the azimuthal angle in spherical coordinates. In particular, on decoding, it is assumed that the loudspeakers, on playback, are far removed. This results in a distortion (or a curving) of the shape of the reconstructed wavefronts. Specifically, as indicated hereinabove, the components of the sound signal in the base of spherical harmonics, for a near field, in fact depend also on the distance of the source and the sound frequency. More precisely, these components may be expressed mathematically in the form of a polynomial whose variable is inversely proportional to the aforesaid distance and to the sound frequency. Thus, the ambisonic components, in the sense of their theoretical expression, are divergent in the low frequencies and, in particular, tend to infinity when the sound frequency decreases to zero, when they represent a near field sound emitted by a source situated at a finite distance. This mathematical phenomenon is known, in the realm of ambisonic representation, already for order 1, by the term "bass boost", in particular through:

M. A. GERZON, "*General Metatheory of Auditory Localisation*", preprint 3306 of the 92$^{nd}$ AES Convention, 1992, page 52.

This phenomenon becomes particularly critical for high spherical harmonic orders involving polynomials of high power.

The following document:

SONTACCHI and HÖLDRICH, "*Further Investigations on 3D Sound Fields using Distance Coding*" (Proceedings of the COST G-6 Conference on Digital Audio Effects (DAFX-01), Limerick, Ireland, 6-8 Dec. 2001), discloses a technique for taking account of a curving of the wavefronts within a near representation of an ambisonic representation, the principle of which consists in:

applying an ambisonic encoding (of high order) to the signals arising from a (simulated) virtual sound capture, of WFS type (standing for "Wave Field Synthesis");

and reconstructing the acoustic field over a zone according to its values over a zone boundary, thus based on the HUYGENS-FRESNEL principle.

However, the technique presented in this document, although promising on account of the fact that it uses an ambisonic representation to a high order, poses a certain number of problems:

the computer resources required for the calculation of all the surfaces making it possible to apply the HUYGENS-FRESNEL principle, as well as the calculation times required, are excessive;

processing artifacts referred to as "spatial aliasing" appear on account of the distance between the microphones, unless a tightly spaced virtual microphone grid is chosen, thereby making the processing more cumbersome;

this technique is difficult to transpose over to a real case of sensors to be disposed in an array, in the presence of a real source, upon acquisition;

on playback, the three-dimensional sound representation is implicitly bound to a fixed radius of the playback device since the ambisonic decoding must be done, here, on an array of loudspeakers of the same dimensions as the initial array of microphones, this document proposing no means of adapting the encoding or the decoding to other sizes of playback devices.

Above all, this document presents a horizontal array of sensors, thereby assuming that the acoustic phenomena in question, here, propagate only in horizontal directions, thereby excluding any other direction of propagation and thus not representing the physical reality of an ordinary acoustic field.

More generally, current techniques do not make it possible to satisfactorily process any type of sound source, in particular a near field source, but rather far removed sound sources (plane waves), this corresponding to a restrictive and artificial situation in numerous applications.

OBJECTS OF THE INVENTION

An object of the present invention is to provide a method for processing, by encoding, transmission and playback, any type of sound field, in particular the effect of a sound source in the near field.

Another object of the present invention is to provide a method allowing the encoding of virtual sources, not only direction-wise, but also distance-wise, and to define a decoding adaptable to any playback device.

Another object of the present invention is to provide a robust method of processing the sounds of any sound frequencies (including low frequencies), in particular for the sound capture of natural acoustic fields with the aid of three-dimensional arrays of microphones.

SUMMARY OF THE INVENTION

To this end, the present invention proposes a method of processing sound data, wherein, before a playback of the sound by a playback device:

a) signals representative of at least one sound propagating in a three-dimensional space and arising from a source situated at a first distance from a reference point are coded so as to obtain a representation of the sound by components expressed in a base of spherical harmonics, of origin corresponding to said reference point, and b) a compensation of a near field effect is applied to said components by a filtering which is dependent on a second distance defining substantially, for a playback of the sound by a playback device, a distance between a playback point and a point of auditory perception.

In a first embodiment, said source being far removed from the reference point, components of successive orders m are obtained for the representation of the sound in said base of spherical harmonics, and a filter is applied, the coefficients of which, each applied to a component of order m, are expressed analytically in the form of the inverse of a polynomial of power m, whose variable is inversely proportional to the sound frequency and to said second distance, so as to compensate for a near field effect at the level of the playback device.

In a second embodiment, said source being a virtual source envisaged at said first distance, components of successive orders m are obtained for the representation of the sound in said base of spherical harmonics, and a global filter is applied, the coefficients of which, each applied to a component of order m, are expressed analytically in the form of a fraction, in which:

the numerator is a polynomial of power m, whose variable is inversely proportional to the sound frequency and to said first distance, so as to simulate a near field effect of the virtual source, and the denominator is a polynomial of power m, whose variable is inversely proportional to the. sound frequency and to said second distance, so as to compensate for the effect of the near field of the virtual source in the low sound frequencies.

Preferably, one transmits to the playback device the data coded and filtered in steps a) and b) with a parameter representative of said second distance.

As a supplement or as a variant, the playback device comprising means for reading a memory medium, one stores on a memory medium intended to be read by the playback device the data coded and filtered in steps a) and b) with a parameter representative of said second distance.

Advantageously, prior to a sound playback by a playback device comprising a plurality of loudspeakers disposed at a third distance from said point of auditory perception, an adaptation filter whose coefficients are dependent on said second and third distances is applied to the coded and filtered data.

In a particular embodiment, the coefficients of said adaptation filter, each applied to a component of order m, are expressed analytically in the form of a fraction, in which:

the numerator is a polynomial of power m, whose variable is inversely proportional to the sound frequency and to said second distance, and the denominator is a polynomial of power m, whose variable is inversely proportional to the sound frequency and to said third distance.

Advantageously, for the implementation of step b), there is provided:

in respect of the components of even order m, audiodigital filters in the form of a cascade of cells of order two; and in respect of the components of odd order m, audiodigital filters in the form of a cascade of cells of order two and an additional cell of order one.

In this embodiment, the coefficients of an audiodigital filter, for a component of order m, are defined from the numerical values of the roots of said polynomials of power m.

In a particular embodiment, said polynomials are Bessel polynomials.

On acquisition of the sound signals, there is advantageously provided a microphone comprising an array of acoustic transducers arranged substantially on the surface of a sphere whose center corresponds substantially to said reference point, so as to obtain said signals representative of at least one sound propagating in the three-dimensional space.

In this embodiment, a global filter is applied in step b) so as, on the one hand, to compensate for a near field effect as a function of said second distance and, on the other hand, to equalize the signals arising from the transducers so as to compensate for a weighting of directivity of said transducers.

Preferably, there is provided a number of transducers that depends on a total number of components chosen to represent the sound in said base of spherical harmonics.

According to an advantageous characteristic, in step a) a total number of components is chosen from the base of spherical harmonics so as to obtain, on playback, a region of the space around the point of perception in which the playback of the sound is faithful and whose dimensions are increasing with the total number of components.

Preferably, there is furthermore provided a playback device comprising a number of loudspeakers at least equal to said total number of components.

As a variant, within the framework of a playback with binaural or transaural synthesis:

there is provided a playback device comprising at least a first and a second loudspeaker disposed at a chosen distance from a listener, a cue of expected awareness of the position in space of sound sources situated at a predetermined reference distance from the listener is obtained for this listener for applying a so-called "transaural" or "binaural synthesis" technique, and the compensation of step b) is applied with said reference distance substantially as second distance.

In a variant where adaptation is introduced to the playback device with two headphones:

there is provided a playback device comprising at least a first and a second loudspeaker disposed at a chosen distance from a listener, a cue of awareness of the position in space of sound sources situated at a predetermined reference distance from the listener is obtained for this listener, and prior to a sound playback by the playback device, an adaptation filter, whose coefficients are dependent on the second distance and substantially on the reference distance, is applied to the data coded and filtered in steps a) and b).

In particular, within the framework of a playback with binaural synthesis:

the playback device comprises a headset with two headphones for the respective ears of the listener, and preferably, separately for each headphone, the coding and the filtering of steps a) and b) are applied with regard to respective signals intended to be fed to each headphone, with, as first distance, respectively a distance separating each ear from a position of a source to be played back in the playback space.

Preferably, a matrix system is fashioned, in steps a) and b), said system comprising at least:

a matrix comprising said components in the base of spherical harmonics, and a diagonal matrix whose coefficients correspond to filtering coefficients of step b), and said matrices are multiplied to obtain a result matrix of compensated components.

By preference, on playback:

the playback device comprises a plurality of loudspeakers disposed substantially at one and the same distance from the point of auditory perception, and to decode said data coded and filtered in steps a) and b) and to form signals suitable for feeding said loudspeakers:

a matrix system is formed comprising said result matrix of compensated components, and a predetermined decoding matrix, specific to the playback device, and a matrix is obtained comprising coefficients representative of the loudspeakers feed signals by multiplication of the result matrix by said decoding matrix.

The present invention is also aimed at a sound acquisition device, comprising a microphone furnished with an array of acoustic transducers disposed substantially on the surface of a sphere. According to the invention, the device furthermore comprises a processing unit arranged so as to:

receive signals each emanating from a transducer, apply a coding to said signals so as to obtain a representation of the sound by components expressed in a base of spherical harmonics, of origin corresponding to the center of said sphere, and apply a filtering to said components, which filtering is dependent, on the one hand, on a distance corresponding to the radius of the sphere and, on the other hand, on a reference distance.

Preferably, the filtering performed by the processing unit consists, on the one hand, in equalizing, as a function of the radius of the sphere, the signals arising from the transducers so as to compensate for a weighting of directivity of said transducers and, on the other hand, in compensating for a near field effect as a function of said reference distance.

BRIEF DESCRIPTION OF THE DRAWINGS

Other advantages and characteristics of the invention will become apparent on reading the detailed description hereinbelow and on examining the figures which accompany same, in which.

DETAILED DESCRIPTION OF THE INVENTION

Figure 1:
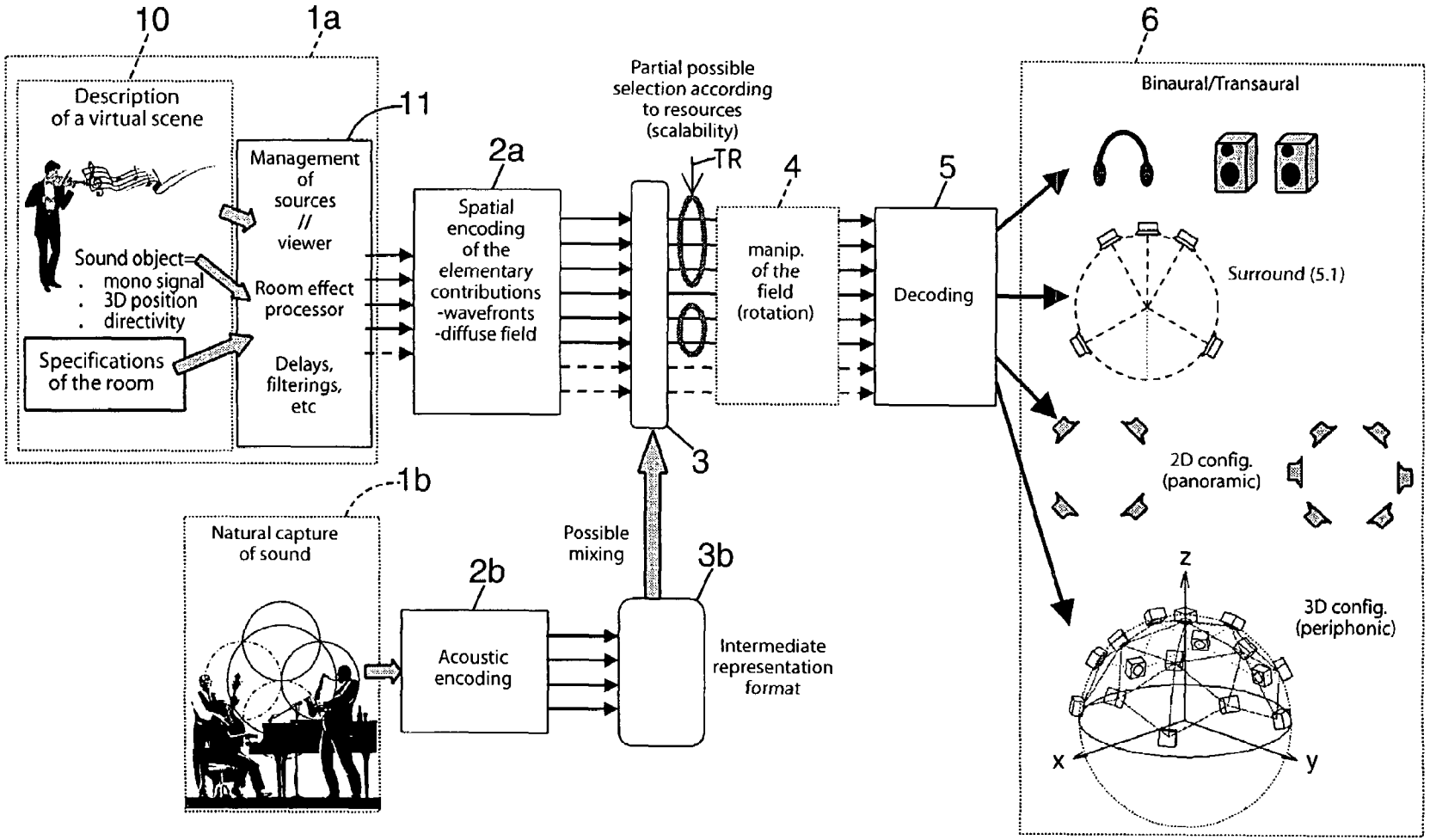
FIG. 1 diagrammatically illustrates a system for acquiring and creating, by simulation of virtual sources, sound signals, with encoding, transmission, decoding and playback by a spatialized playback device.

Reference is firstly made to FIG. 1 which represents by way of illustration a global system for sound spatialization. A module 1*a* for simulating a virtual scene defines a sound object as a virtual source of a signal, for example monophonic, with chosen position in three-dimensional space and which defines a direction of the sound. Specifications of the geometry of a virtual room may furthermore be provided so as to simulate a reverberation of the sound. A processing module 11 applies a management of one or more of these sources with respect to a listener (definition of a virtual position of the sources with respect to this listener). It implements a room effect processor for simulating reverberations or the like by applying delays and/or standard filterings. The signals thus constructed are transmitted to a module 2*a* for the spatial encoding of the elementary contributions of the sources.

In parallel with this, a natural capture of sound may be performed within the framework of a sound recording by one or more microphones disposed in a chosen manner with respect to the real sources (module 1*b*). The signals picked up by the microphones are encoded by a module 2*b*. The signals acquired and encoded may be transformed according to an intermediate representation format (module 3*b*), before being mixed by the module 3 with the signals generated by the module 1*a* and encoded by the module 2*a* (arising from the virtual sources). The mixed signals are thereafter transmitted, or else stored on a medium, with a view to a later playback (arrow TR). They are thereafter applied to a decoding module 5, with a view to playback on a playback device 6 comprising loudspeakers. As the case may be, the decoding step 5 may be preceded by a step of manipulating the sound field, for example by rotation, by virtue of a processing module 4 provided upstream of the decoding module 5.

The playback device may take the form of a multiplicity of loudspeakers, arranged for example on the surface of a sphere in a three-dimensional (periphonic) configuration so as to ensure, on playback, in particular an awareness of a direction of the sound in three-dimensional space. For this purpose, a listener generally stations himself at the center of the sphere formed by the array of loudspeakers, this center corresponding to the abovementioned point of auditory perception. As a variant, the loudspeakers of the playback device may be arranged in a plane (bidimensional panoramic configuration), the loudspeakers being disposed in particular on a circle and the listener usually stationed at the center of this circle. In another variant, the playback device may take the form of a device of "surround" type (5.1). Finally, in an advantageous variant, the playback device may take the form of a headset with two headphones for binaural synthesis of the sound played back, which allows the listener to be aware of a direction of the sources in three-dimensional space, as will be seen further on in detail. Such a playback device with two loudspeakers, for awareness in three-dimensional space, may also take the form of a transaural playback device, with two loudspeakers disposed at a chosen distance from a listener.

Figure 2:
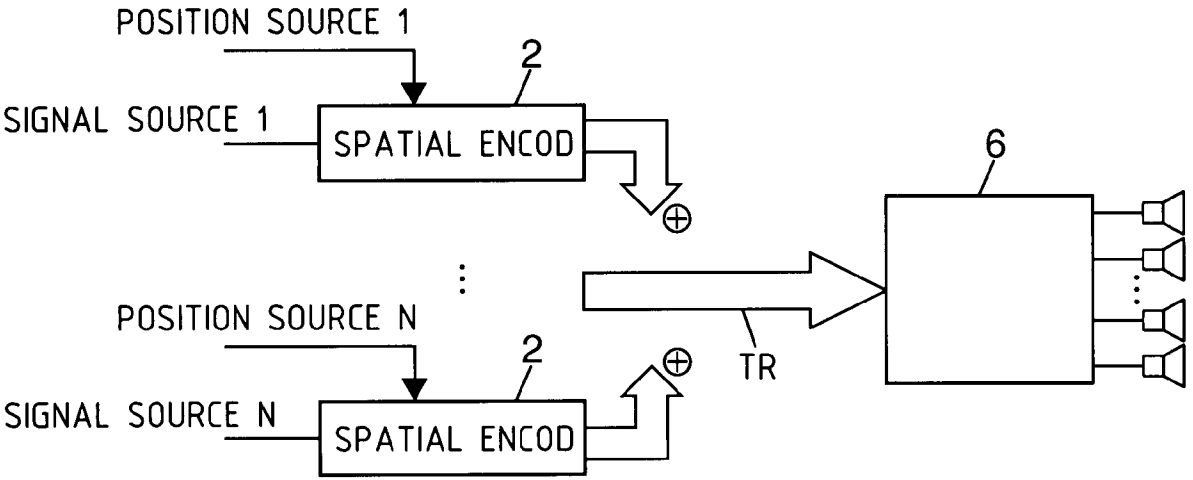
FIG. 2 represents more precisely an encoding of signals defined both intensity-wise and with respect to the position of a source from which they arise.

Reference is now made to FIG. 2 to describe a spatial encoding and a decoding for a three-dimensional sound playback, of elementary sound sources. The signal arising from a source 1 to N, as well as its position (real or virtual) are transmitted to a spatial encoding module 2. Its position may equally well be defined in terms of incidence (direction of the source viewed from the listener) or in terms of distance between this source and a listener. The plurality of the signals thus encoded makes it possible to obtain a multichannel representation of a global sound field. The signals encoded are transmitted (arrow TR) to a sound playback device 6, for sound playback in three-dimensional space, as indicated hereinabove with reference to FIG. 1.

Figure 3:
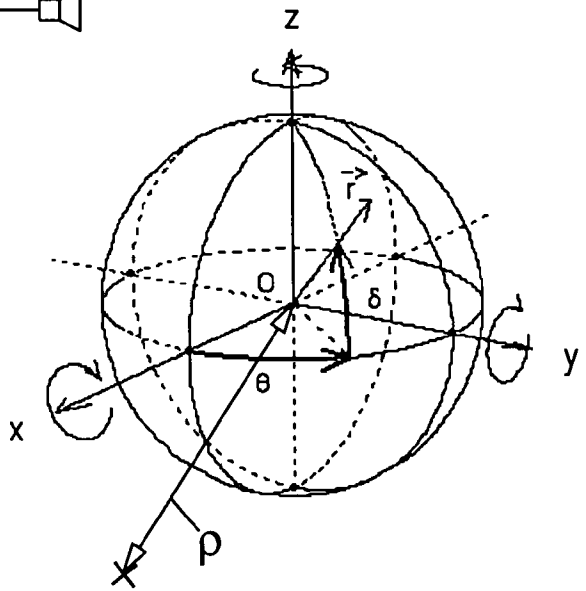
FIG. 3 illustrates the parameters involved in the ambisonic representation, in spherical coordinates.

Reference is now made to FIG. 3 to describe hereinbelow the ambisonic representation by spherical harmonics in three-dimensional space, of an acoustic field. We consider a zone about an origin O (sphere of radius R) devoid of any acoustic source. We adopt a system of spherical coordinates in which each vector r from the origin O to a point of the sphere is described by an azimuth $\theta_r$, an elevation $\delta_r$ and a radius r (corresponding to the distance from the origin O).

The pressure field $p(\vec{r})$ inside this sphere (r<R where R is the radius of the sphere) may be written in the frequency domain as a series whose terms are the weighted products of angular functions $y_{mn}^{\sigma}(\theta, \delta)$ and of the radial function $j_m(kr)$ which thus depend on a propagation term where $k=2\pi f/c$, where f is the sound frequency and c is the speed of sound in the propagation medium.

The pressure field may then be expressed as:

$$p(\vec{r}) = \sum_{m=0}^{\infty} j^m j_m(kr) \sum_{0\le n\le m,\sigma=\pm 1} B_{mn}^{\sigma} Y_{mn}^{\sigma(N3D)}(\theta_r, \delta_r) \quad [A1]$$

The set of weighting factors $B_{mn}^{\sigma}$, which are implicitly dependent on frequency, thus describe the pressure field in the zone considered. For this reason, these factors are called "spherical harmonic components" and represent a frequency expression for the sound (or for the pressure field) in the base of spherical harmonics $Y_{mn}^{\sigma}$.

The angular functions are called "spherical harmonics" and are defined by:

$$Y_{mn}^{\sigma}(\theta, \delta) = \sqrt{2m+1}\sqrt{(2-\delta_{0;n})\frac{(m-n)!}{(m+n)!}}\, P_{mn}(\sin\delta) \times \begin{cases} \cos n\theta & \text{if } \sigma = +1 \\ \sin n\theta & \text{if } \sigma = -1 \end{cases} \quad [A2]$$

where $P_{mn}(\sin\delta)$ are Legendre functions of degree m and of order n;

$\delta_{p,q}$ is the Krönecker symbol (equal to 1 if p=q and 0 otherwise).

Spherical harmonics form an orthonormal base where the scalar products between harmonic components and, in a general manner between two functions F and G, are respectively defined by:

$$(Y_{mn}^{\sigma}|Y_{m'n'}^{\sigma'})_{4\pi}=\delta_{mm'}\delta_{nn'}\delta_{\sigma\sigma'}. \quad [A'2]$$

$$\langle F|G\rangle_{4\pi} = \frac{1}{4\pi}\oiint F(\theta, \delta)G(\theta, \delta), d\Omega(\theta, \delta)$$

Figure 4:
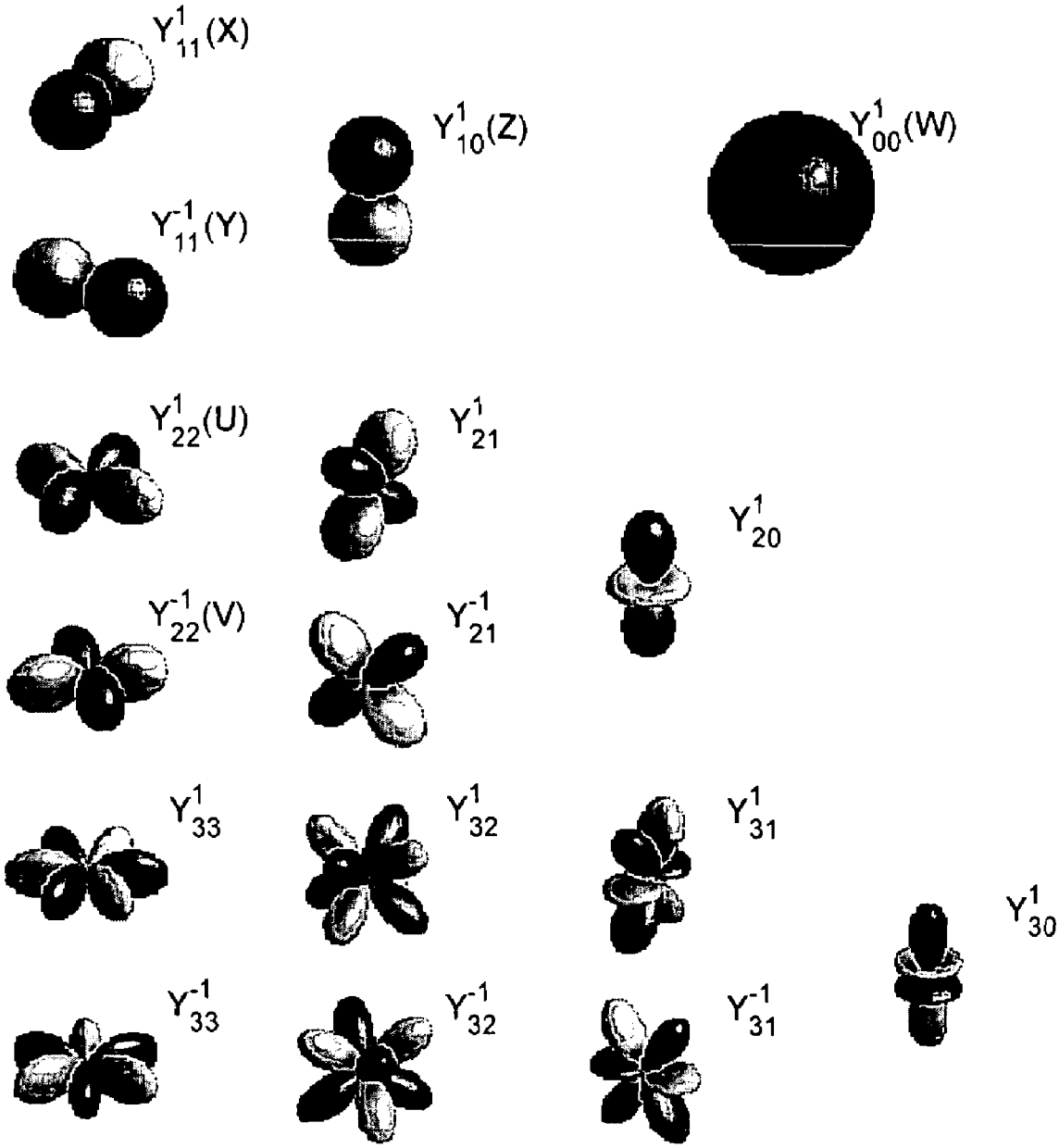
FIG. 4 illustrates a representation by a three-dimensional metric in a reference frame of spherical coordinates, of spherical harmonics $Y_{mn}^{\sigma}$ of various orders.
Figure 5:
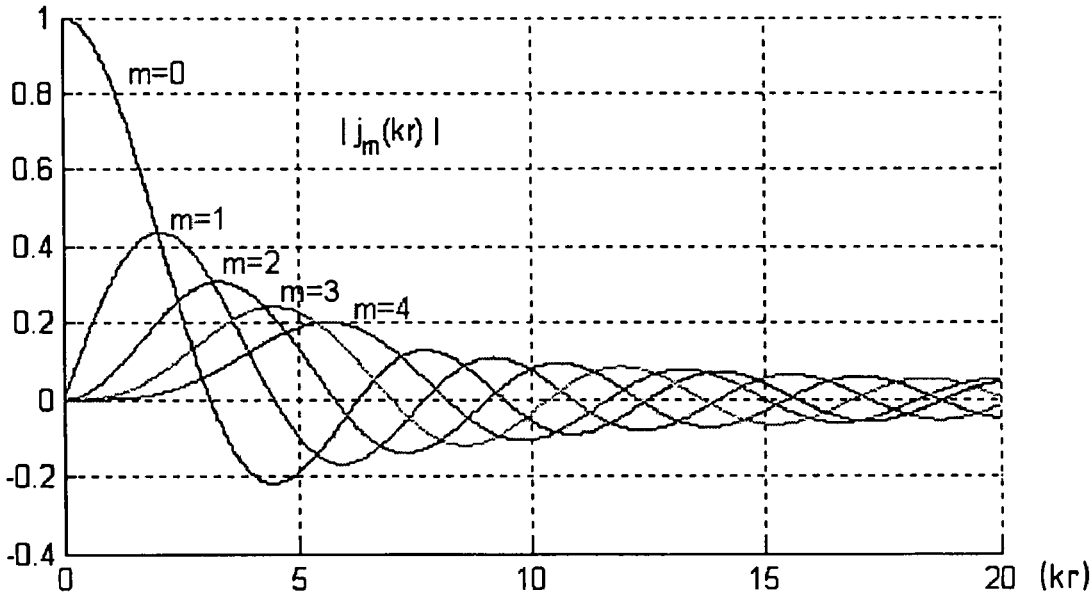
FIG. 5 is a chart of the variations of the modulus of radial functions $j_m(kr)$, which are spherical Bessel functions, for successive values of order m, these radial functions coming into the ambisonic representation of an acoustic pressure field.

Spherical harmonics are real functions that are bounded, as represented in FIG. 4, as a function of the order m and of the indices n and σ. The light and dark parts correspond respectively to the positive and negative values of the spherical harmonic functions. The higher the order m, the higher the angular frequency (and hence the discrimination between functions). The radial functions $j_m(kr)$ are spherical Bessel functions, whose modulus is illustrated for a few values of the order m in FIG. 5.

An interpretation of the ambisonic representation by a base of spherical harmonics may be given as follows. The ambisonic components of like order m ultimately express "derivatives" or "moments" of order m of the pressure field in the neighborhood of the origin O (center of the sphere represented in FIG. 3).

In particular, $B_{00}^{+1}=W$ describes the scalar magnitude of the pressure, while $B_{11}^{+1}=X$, $B_{11}^{1}=Y$, $B_{10}^{+1}=Z$ are related to the pressure gradients (or else to the particular velocity) at the origin O. These first four components W, X, Y and Z are obtained during the natural capture of sound with the aid of omnidirectional microphones (for the component W of order 0) and bidirectional microphones (for the subsequent other three components). By using a larger number of acoustic transducers, an appropriate processing, in particular by equalization, makes it possible to obtain further ambisonic components (higher orders m greater than 1).

By taking into account the additional components of higher order (greater than 1), hence by increasing the angular resolution of the ambisonic description, access is gained to an approximation of the pressure field over a wider neighborhood with regard to the wavelength of the sound wave, about the origin O. It will thus be understood that there exists a tight relation between the angular resolution (order of the spherical harmonics) and the radial range (radius r) which can be represented. In short, on moving spatially away from the origin point O of FIG. 3, the higher is the number of ambisonic components (order M high) and the better is the representation of the sound by the set of these ambisonic components. It will also be understood that the ambisonic representation of the sound is however less satisfactory as one moves away from the origin O. This effect becomes critical in particular for high sound frequencies (of short wavelength). It is therefore of interest to obtain the largest possible number of ambisonic components, thereby making it possible to create a region of space around the point of perception and in which the playback of the sound is faithful and whose dimensions are increasing with the total number of components.

Described hereinbelow is an application to a spatialized sound encoding/transmission/playback system.

In practice, an ambisonic system takes into account a subset of spherical harmonic components, as described hereinabove. One speaks of a system of order M when the latter takes into account ambisonic components of index m<M. When dealing with playback by a playback device with loudspeakers, it will be understood that if these loudspeakers are disposed in a horizontal plane, only the harmonics of index m =n are utilized. On the other hand, when the playback device comprises loudspeakers disposed over the surface of a sphere ("periphony"), it is in principle possible to utilize as many harmonics as there exist loudspeakers.

The reference S designates the pressure signal carried by a plane wave and picked up at the point O corresponding to the center of the sphere of FIG. 3 (origin of the base in spherical coordinates). The incidence of the wave is described by the azimuth θ and the elevation δ. The expression for the components of the field associated with this plane wave is given by the relation:

$$B_{mn}^{\sigma}=S.Y_{mn}^{\sigma}(\theta, \delta) \quad [A3]$$

To encode (simulate) a near field source at a distance ρ from the origin O, a filter $F_m^{(\rho/c)}$ is applied so as to "curve" the shape of the wavefronts, by considering that a near field emits, to a first approximation, a spherical wave. The encoded components of the field become:

$$B_{mn}^{\sigma}=S.F_m^{(\rho/c)}(\omega)Y_{mn}^{\sigma}(\theta,\delta) \quad [A4]$$

and the expression for the aforesaid filter $F_m^{(\rho/c)}$ is given by the relation:

$$F_m^{(\rho/c)}(\omega) = \sum_{n=0}^{m} \frac{(m+n)!}{(m-n)!n!}(2j\omega\rho/c)^{-n} \quad [A5]$$

where $\omega=2\pi f$ is the angular frequency of the wave, f being the sound frequency.

These latter two relations [A4] and [A5] ultimately show that, both for a virtual source (simulated) and for a real source in the near field, the components of the sound in the ambisonic representation are expressed mathematically (in particular analytically) in the form of a polynomial, here a Bessel polynomial, of power m and whose variable ($c/2j\omega\rho$) is inversely proportional to the sound frequency.

Thus, it will be understood that:

- in the case of a plane wave, the encoding produces signals which differ from the original signal only by a real, finite gain, this corresponding to a purely directional encoding (relation [A3]);
- in the case of a spherical wave (near field source), the additional filter $F_m^{(\rho/c)}(\omega)$ encodes the distance cue by introducing, into the expression for the ambisonic components, complex amplitude ratios which depend on frequency, as expressed in relation [A5].

Figure 6:
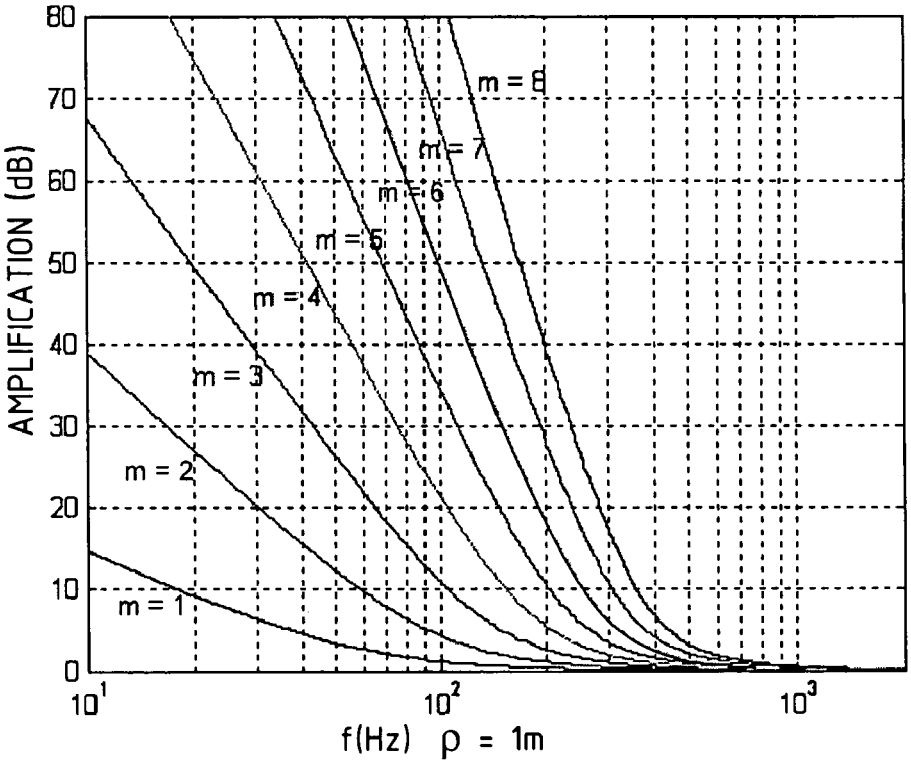
FIG. 6 represents the amplification due to the near field effect for various successive orders m, in particular in the low frequencies.

It should be noted that this additional filter is of "integrator" type, with an amplification effect that increases and diverges (is unbounded) as the sound frequencies decrease toward zero. FIG. 6 shows, fore each order m, an increase in the gain at low frequencies (here the first distance $\rho=1$ m). One is therefore dealing with unstable and divergent filters when seeking to apply them to any audio signals. This divergence is all the more critical for orders m of high value.

It will be understood in particular, from relations [A3], [A4] and [A5], that the modeling of a virtual source in the near field exhibits divergent ambisonic components at low frequencies, in a manner which is particularly critical for high orders m, as is represented in FIG. 6. This divergence, in the low frequencies, corresponds to the phenomenon of "bass boost" stated hereinabove. It also manifests itself in sound acquisition, for real sources.

For this reason in particular, the ambisonic approach, especially for high orders m, has not experienced, in the state of the art, concrete application (other than theoretical) in the processing of sound.

Figure 7:
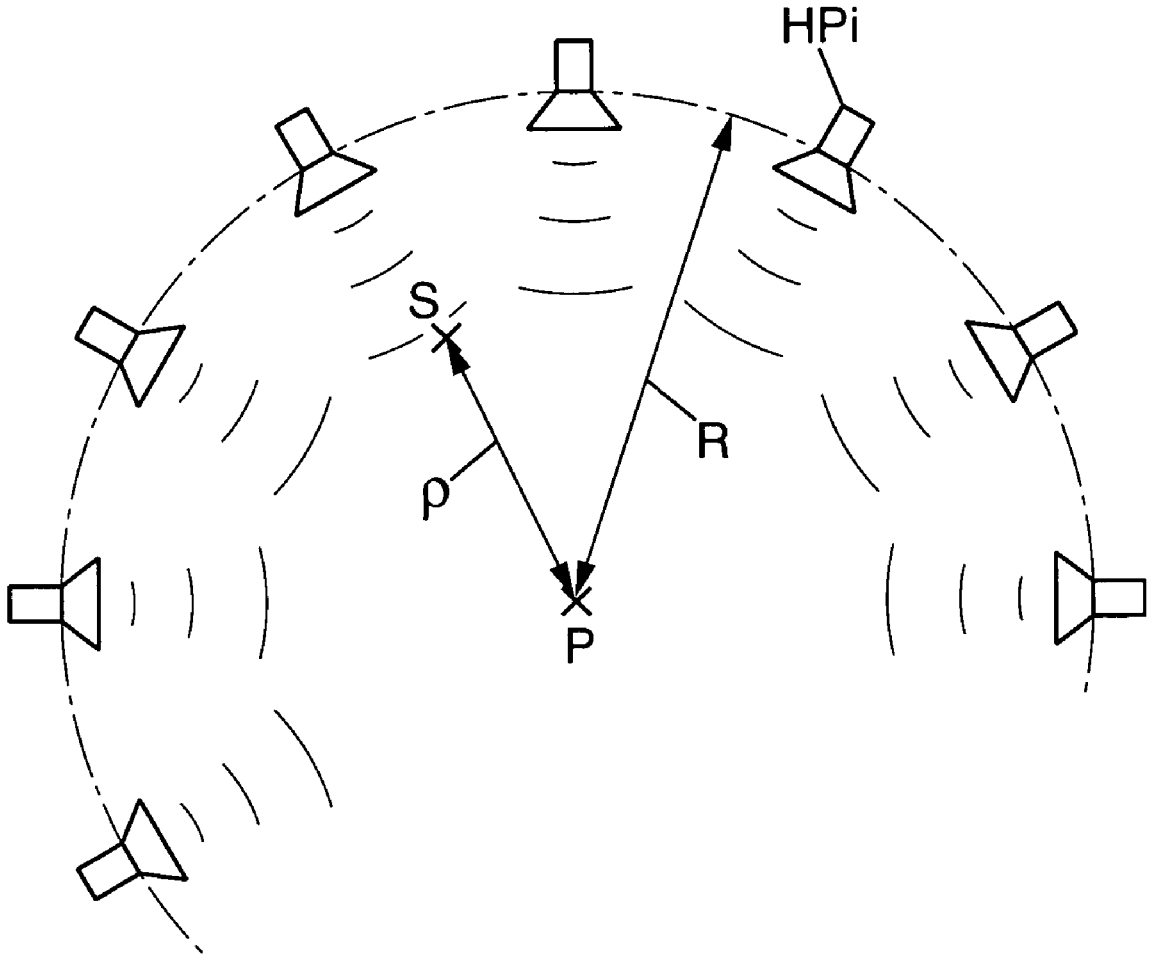
FIG. 7 diagrammatically represents a playback device comprising a plurality of loudspeakers $HP_r$, with the aforesaid point (reference P) of auditory perception, the first aforesaid distance (referenced ρ) and the second aforesaid distance (referenced R)

It is understood in particular that compensation of the near field is necessary so as to comply, on playback, with the shape of the wavefronts encoded in the ambisonic representation. Referring to FIG. 7, a playback device comprises a plurality of loudspeakers $HP_i$, disposed at one and the same distance R, in the example described, from a point of auditory perception P. In this FIG. 7:

- each point at which a loudspeaker $HP_i$ is situated corresponds to a playback point stated hereinabove,
- the point P is the above-stated point of auditory perception,
- these points are separated by the second distance R stated hereinabove, while in FIG. 3 described hereinabove:
- the point O corresponds to the reference point, stated hereinabove, which forms the origin of the base of spherical harmonics,
- the point M corresponds to the position of a source (real or virtual) situated at the first distance $\rho$, stated hereinabove, from the reference point O.

According to the invention, a pre-compensation of the near field is introduced at the actual encoding stage, this compensation involving filters of the analytical form $$\frac{1}{F_m^{(R/c)}(\omega)}$$

and which are applied to the aforesaid ambisonic components $B_{mn}^{\sigma}$.

According to one of the advantages afforded by the invention, the amplification $F_m^{(\rho/c)}(\omega)$ whose effect appears in FIG. 6 is compensated for through the attenuation of the filter applied subsequent to the encoding $$\frac{1}{F_m^{(R/c)}(\omega)}.$$

In particular, the coefficients of this compensation filter $$\frac{1}{F_m^{(R/c)}(\omega)}$$

increase with sound frequency and, in particular, tend to zero, for low frequencies. Advantageously, this pre-compensation, performed right from the encoding, ensures that the data transmitted are not divergent for low frequencies.

To indicate the physical significance of the distance R which comes into the compensation filter, we consider, by way of illustration, an initial, real plane wave upon the acquisition of the sound signals. To simulate a near field effect of this far source, one applies the first filter of relation [A5], as indicated in relation [A4]. The distance $\rho$ then represents a distance between a near virtual source M and the point O representing the origin of the spherical base of FIG. 3. A first filter for near field simulation is thus applied to simulate the presence of a virtual source at the above-described distance $\rho$. Nevertheless, on the one hand, as indicated hereinabove, the terms of the coefficient of this filter diverge in the low frequencies (FIG. 6) and, on the other hand, the aforesaid distance $\rho$ will not necessarily represent the distance between loudspeakers of a playback device and a point P of perception (FIG. 7). According to the invention, a pre-compensation is applied, on encoding, involving a filter of the type $$\frac{1}{F_m^{(R/c)}(\omega)}$$

as indicated hereinabove, thereby making it possible, on the one hand, to transmit bounded signals, and, on the other hand, to choose the distance R, right from the encoding, for the playback of the sound using the loudspeakers $HP_i$, as represented in FIG. 7. In particular, it will be understood that if one has simulated, on acquisition, a virtual source placed at the distance p from the origin O, on playback (FIG. 7), a listener stationed at the point P of auditory perception (at a distance R from the loudspeakers $HP_i$) will be aware, on listening, of the presence of a sound source S, stationed at the distance $\rho$ from the point of perception P and which corresponds to the virtual source simulated during acquisition.

Thus, the pre-compensation of the near field of the loudspeakers (stationed at the distance R), at the encoding stage, may be combined with a simulated near field effect of a virtual source stationed at a distance $\rho$. On encoding, a total filter resulting, on the one hand, from the simulation of the near field, and, on the other hand, from the compensation of the near field, is ultimately brought into play, the coefficients of this filter being expressable analytically by the relation:

$$H_m^{NFC(\rho/c,R/c)}(\omega) = \frac{F_m^{(\rho/c)}(\omega)}{F_m^{(R/c)}(\omega)} \qquad \text{[A11]}$$

Figure 8:
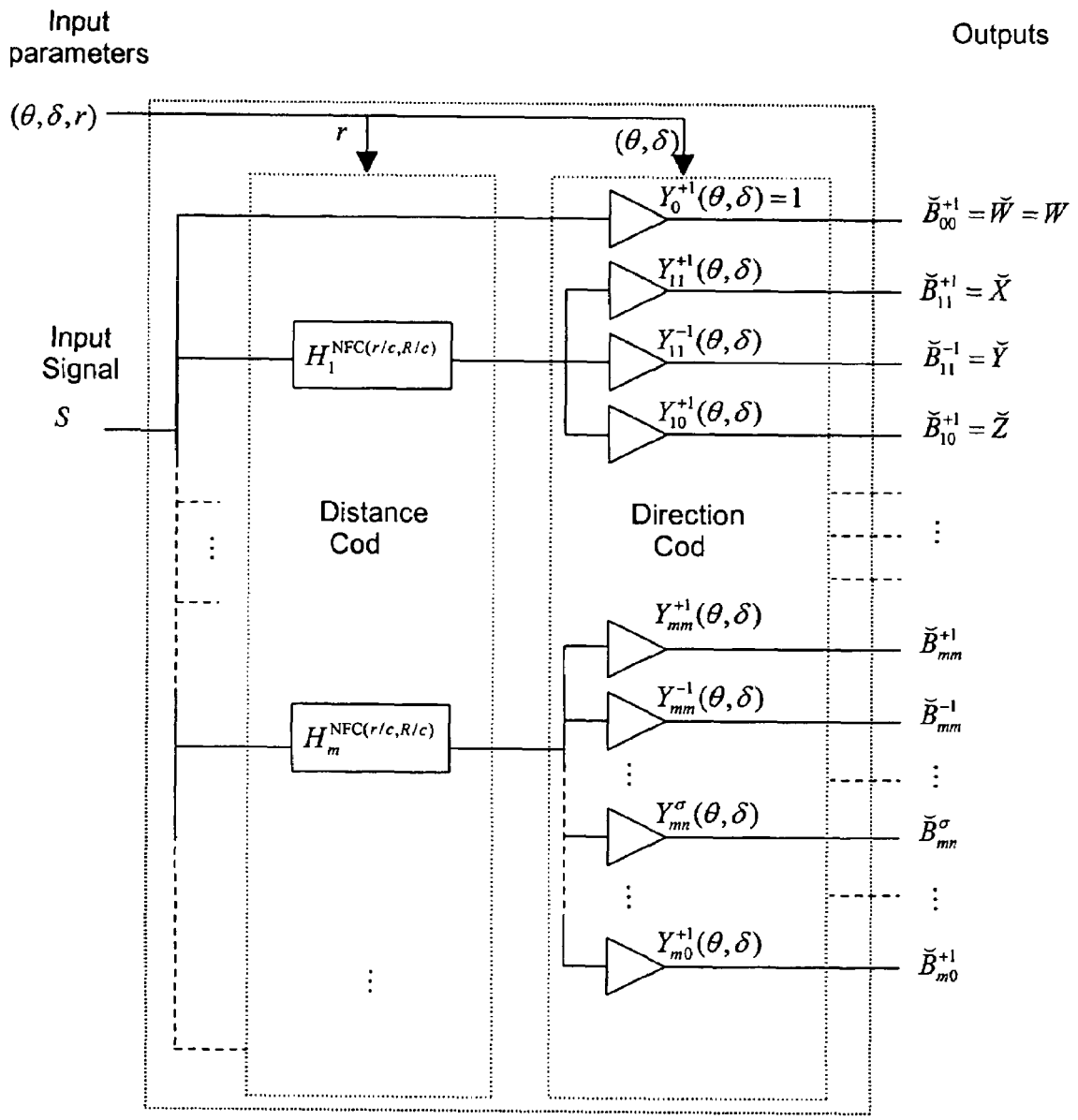
FIG. 8 diagrammatically represents the parameters involved in the ambisonic encoding, with a directional encoding, as well as a distance encoding according to the invention.

The total filter given by relation [A11] is stable and constitutes the "distance encoding" part in the spatial ambisonic encoding according to the invention, as represented in FIG. 8. The coefficients of these filters correspond to monotonic transfer functions for the frequency, which tend to the value 1 at high frequencies and to the value $(R/\rho)^m$ at low frequencies. By referring to FIG. 9, the energy spectra of the filters $H_m^{NFC(\rho/c,R/c)}(\omega)$ convey the amplification of the encoded components, that are due to the field effect of the virtual source (stationed here at a distance $\rho=1$ m), with a pre-compensation of the field of loudspeakers (stationed at a distance R=1.5 m). The amplification in decibels is therefore positive when $\rho<R$ (case of FIG. 9) and negative when $\rho>R$ (case of FIG. 10 where $\rho=3$ m and R=1.5 m). In a spatialized playback device, the distance R between a point of auditory perception and the loudspeakers $HP_i$ is actually of the order of one or a few meters.

Referring again to FIG. 8, it will be understood that, apart from the customary direction parameters θ and δ, a cue regarding the distances which are involved in the encoding will be transmitted. Thus, the angular functions corresponding to the spherical harmonics $Y_{mn}^{\sigma(\theta,\delta)}$ are retained for the directional encoding.

However, within the sense of the present invention, provision is furthermore made for total filters (near field compensation and, as the case may be, simulation of a near field) $H_m^{NFC(\rho/c,R/c)}(\omega)$ which are applied to the ambisonic components, as a function of their order m, to achieve the distance encoding, as represented in FIG. 8. An embodiment of these filters in the audiodigital domain will be described in detail later on.

It will be noted in particular that these filters may be applied right from the very distance encoding (r) and even before the direction encoding (θ, δ). It will thus be understood that steps a) and b) hereinabove may be brought together into one and the same global step, or even be swapped (with a distance encoding and compensation filtering, followed by a direction encoding). The method according to the invention is therefore not limited to successive temporal implementation of steps a) and b).

Figure 11A:
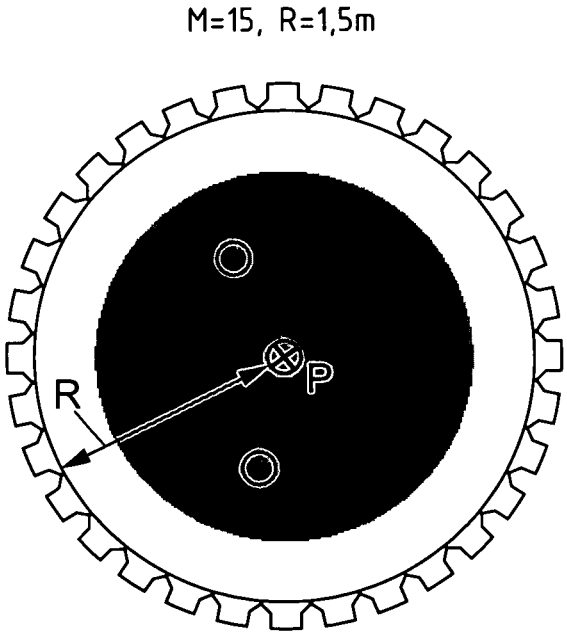
FIG. 11A represents a reconstruction of the near field with compensation, in the sense of the present invention, for a spherical wave in the horizontal plane.
Figure 11B:
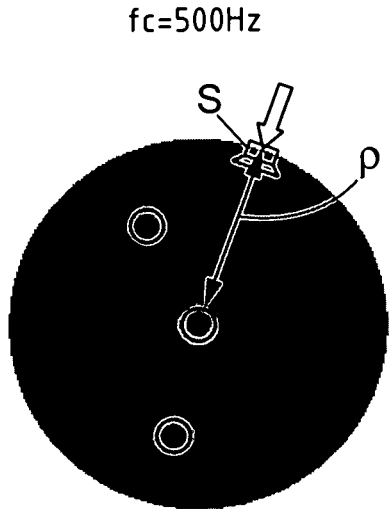
FIG. 11B, to be compared with FIG. 11A, represents the initial wavefront, arising from a source S.

FIG. 11A represents a visualization (viewed from above) of a reconstruction of a near field with compensation, of a spherical wave, in the horizontal plane (with the same distance parameters as those of FIG. 9), for a system of total order M=15 and a playback on 32 loudspeakers. Represented in FIG. 11B is the propagation of the initial sound wave from a near field source situated at a distance ρ from a point of the acquisition space which corresponds, in the playback space, to the point P of FIG. 7 of auditory perception. It is noted in FIG. 11A that the listeners (symbolized by schematized heads) may pinpoint the virtual source at one and the same geographical location situated at the distance ρ from the point of perception P in FIG. 11B.

It is thus indeed verified that the shape of the encoded wavefront is complied with after decoding and playback. However, interference on the right of the point P such as represented in FIG. 11A is noticeable, this interference being due to the fact that the number of loudspeakers (hence of ambisonic components taken into account) is not sufficient for perfect reconstruction of the wavefront involved over the whole surface delimited by the loudspeakers.

In what follows, we describe, by way of example, the obtaining of an audiodigital filter for the implementation of the method within the sense of the invention.

As indicated hereinabove, if one is seeking to simulate a near field effect, compensated right from encoding, a filter of the form:

$$H_m^{NFC(\rho/c,R/c)}(\omega) = \frac{F_m^{(\rho/c)}(\omega)}{F_m^{(R/c)}(\omega)} \quad [A11]$$

is applied to the ambisonic components of the sound.

From the expression for the simulation of a near field given by relation [A5], it is apparent that for far sources ($\rho=\infty$), relation [A11] simply becomes:

$$\frac{1}{F_m^{(R/c)}(\omega)} = H_m^{NFC(\infty,R/c)}(\omega) \quad [A12]$$

It is therefore apparent from this latter relation [A12] that the case where the source to be simulated emits in the far field (far source) it is merely a particular case of the general expression for the filter, as formulated in relation [A11].

Within the realm of audio digital processing, an advantageous method of defining a digital filter from the analytical expression of this filter in the continuous-time analog domain consists of a "bilinear transform".

Relation [A5] is firstly expressed in the form of a Laplace transform, this corresponding to:

$$F_m^{(\tau)}(p) = \sum_{n=0}^{m} \frac{(m+n)!}{(m-n)!n!}(2\tau p)^{-n} \quad [A13]$$

where $\tau=\rho/c$ (c being the acoustic speed in the medium, typically 340 m/s in air).

The bilinear transform consists in presenting, for a sampling frequency $f_s$, relation [A11] in the form:

$$Hm(z) = \prod_{q=1}^{m/2} \frac{b_0^q + b_1^q z^{-1} + b_2^q z^{-2}}{a_0^q + a_1^q z^{-1} + a_2^q z^{-2}} \times \frac{b_0^{(m+1)/2} + b_1^{(m+1)/2} z^{-1}}{a_0^{(m+1)/2} + a_1^{(m+1)/2} z^{-1}} \quad [A14]$$

if m is odd and $$H_m(z) = \prod_{q=1}^{m/2} \frac{b_0^q + b_1^q z^{-1} + b_2^q z^{-2}}{a_0^q + a_1^q z^{-1} + a_2^q z^{-2}}$$

if m is even, where z is defined by $$p = 2f_s \frac{1-z^{-1}}{1+z^{-1}}$$

with respect to the above relation [A13], and with:

$$x_0 = 1 - 2\frac{\mathrm{Re}(X_{m,q})}{\alpha} + \frac{|X_{m,q}|^2}{\alpha^2},\ x_1 = -2\left(1 - \frac{|X_{m,q}|^2}{\alpha^2}\right)$$

and $$x_2 = 1 + 2\frac{\mathrm{Re}(X_{m,q})}{\alpha} + \frac{|X_{m,q}|^2}{\alpha^2}$$

$$x_0^{(m+1)/2} = 1 - \frac{X_{m,q}}{\alpha} \text{ and } x_1^{(m+1)/2} = -\left(1 + \frac{X_{m,q}}{\alpha}\right)$$

where $\alpha=4f_s R/c$ for x=a and $\alpha=4f_s \rho/c$ for x=b $X_{m,q}$ are the q successive roots of the Bessel polynomial:

$$F_m(x) = \sum_{n=0}^{m} \frac{(m+n)!}{(m-n)!n!} X^{m-n} = \prod_{q=1}^{m} (X - X_{m,q})$$

and are expressed in table 1 hereinbelow, for various orders m, in the respective forms of their real part, their modulus (separated by a comma) and their (real) value when m is odd.

TABLE 1 values $R_e[X_{m,q}]$, $|X_{m,q}|$ (and $R_e[X_{m,m}]$ when m is odd) of a Bessel polynomial as calculated with the aid of the MATLAB © computation software.

| | |
|---|---|
| m = 1 | −2.0000000000 |
| m = 2 | −3.0000000000, 3.4641016151 |
| m = 3 | −3.6778146454, 5.0830828022; −4.6443707093 |
| m = 4 | −4.2075787944, 6.7787315854; −5.7924212056, 6.0465298776 |
| m = 5 | −4.6493486064, 8.5220456027; −6.7039127983, 7.5557873219; −7.2934771907 |
| m = 6 | −5.0318644956, 10.2983543043; −7.4714167127, 9.1329783045; −8.4967187917, 8.6720541026 |
| m = 7 | −5.3713537579, 12.0990553610; −8.1402783273, 10.7585400670; −9.5165810563, 10.1324122997; −9.9435737171 |
| m = 8 | −5.6779678978, 13.9186233016; −8.7365784344, 12.4208298072; −10.4096815813, 11.6507064310; −11.1757720865, 11.3096817388 |
| m = 9 | −5.9585215964, 15.7532774523; −9.2768797744, 14.1121936859; −11.2088436390, 13.2131216226; −12.2587358086, 12.7419414392; −12.5940383634 |
| m = 10 | −6.2178324673, 17.6003068759; −9.7724391337, 15.8272658299; −11.9350566572, 14.8106929213; −13.2305819310, 14.2242555605; −13.8440898109, 13.9524261065 |
| m = 11 | −6.4594441798, 19.4576958063; −10.2312965678, 17.5621095176; −12.6026749098, 16.4371594915; −14.1157847751, 15.7463731900; −14.9684597220, 15.3663558234; −15.2446796908 |
| m = 12 | −6.6860466156, 21.3239012076; −10.6594171817, 19.3137363168; −13.2220085001, 18.0879209819; −14.9311424804, 17.3012295772; −15.9945411996, 16.8242165032; −16.5068440226, 16.5978151615 |
| m = 13 | −6.8997344413, 23.1977134580; −11.0613619668, 21.0798161546; −13.8007456514, 19.7594692366; −15.6887605582, 18.8836767359 −16.9411835315, 18.3181073534; −17.6605041890, 17.9988179873; −17.8954193236 |
| m = 14 | −7.1021737668, 25.0781652657; −11.4407047669, 22.8584924996; −14.3447919297, 21.4490520815; −16.3976939224, 20.4898067617; −17.8220011429, 19.8423306934; −18.7262916698, 19.4389130000; −19.1663428016, 19.2447495545 |
| m = 15 | −7.2947137247, 26.9644699653; −11.8003034312, 24.6482552959; −14.8587939669, 23.1544615283; −17.0649181370, 22.1165594535; −18.6471986915, 21.3925954403; −19.7191341042, 20.9118275261; −20.3418287818, 20.6361378957; −20.5462183256 |
| m = 16 | −7.4784635949, 28.8559784487; −12.1424827551, 26.4478760957; −15.3464816324, 24.8738935490; −17.6959363478, 23.7614799683; −19.4246523327, 22.9655586516; −20.6502404436, 22.4128776078; −21.4379698156, 22.0627133056; −21.8237730778, 21.8926662470 |
| m = 17 | −7.6543475694, 30.7521483222; −12.4691619784, 28.2563077987; −15.8108990691, 26.6058519104; −18.2951775164, 25.4225585034; −20.1605894729, 24.5585534450; −21.5282660840, 23.9384287933; −22.4668764601, 23.5193877036; −23.0161527444, 23.2766166711; −23.1970582109 |
| m = 18 | −7.8231445835, 32.6525213363; −12.7819455282, 30.0726807554; −16.2545681590, 28.3490792784; −18.8662638563, 27.0981271991; −20.8600257104, 26.1693913642; −22.3600808236, 25.4856138632; −23.4378933084, 25.0022244227; −24.1362741870, 24.6925542646; −24.4798038436, 24.5412441597 |
| m = 19 | −7.9855178345, 34.5567065132; −13.0821901901, 31.8962504142; −16.6796008200, 30.1025072510; −19.4122071436, 28.7867778706; −21.5270719955, 27.7962699865; −23.1512112785, 27.0520753105; −24.3584393996, 26.5081174988; −25.1941793616, 26.1363057951; −25.6855663388, 25.9191817486; −25.8480312755 |

The digital filters are thus deployed, using the values of table 1, by providing cascades of cells of order 2 (for m even), and an additional cell (for m odd), using relations [A14] given hereinabove.

Digital filters are thus embodied in an infinite impulse response form, that can be easily parameterized as shown hereinbelow. It should be noted that an implementation in finite impulse response form may be envisaged and consists in calculating the complex spectrum of the transfer function from the analytical formula, then in deducing therefrom a finite impulse response by inverse Fourier transform. A convolution operation is thereafter applied for the filtering.

Thus, by introducing this pre-compensation of the near field on encoding, a modified ambisonic representation (FIG. 8) is defined, adopting as transmissible representation, signals expressed in the frequency domain, in the form:

$$\tilde{B}_{mn}^{\sigma(R/c)} = \frac{1}{F_m^{R/c}(\omega)} B_{mn}^{\sigma} \quad [A15]$$

As indicated hereinabove, R is a reference distance with which is associated a compensated near field effect and c is the speed of sound (typically 340 m/s in air). This modified ambisonic representation possesses the same scalability properties (represented diagrammatically by transmitted data "surrounded" close to the arrow TR of FIG. 1) and obeys the same field rotation transformations (module 4 of FIG. 1) as the customary ambisonic representation.

Indicated hereinbelow are the operations to be implemented for the decoding of the ambisonic signals received.

It is firstly indicated that the decoding operation is adaptable to any playback device, of radius $R_2$, different from the reference distance R hereinabove. For this purpose, filters of the type $H_m^{NFC(\rho/c,R/c)}(\omega)$, such as described earlier, are applied but with distance parameters R and $R_2$, instead of ρ and R. In particular, it should be noted that only the parameter R/c needs to be stored (and/or transmitted) between the encoding and the decoding.

Figure 12:
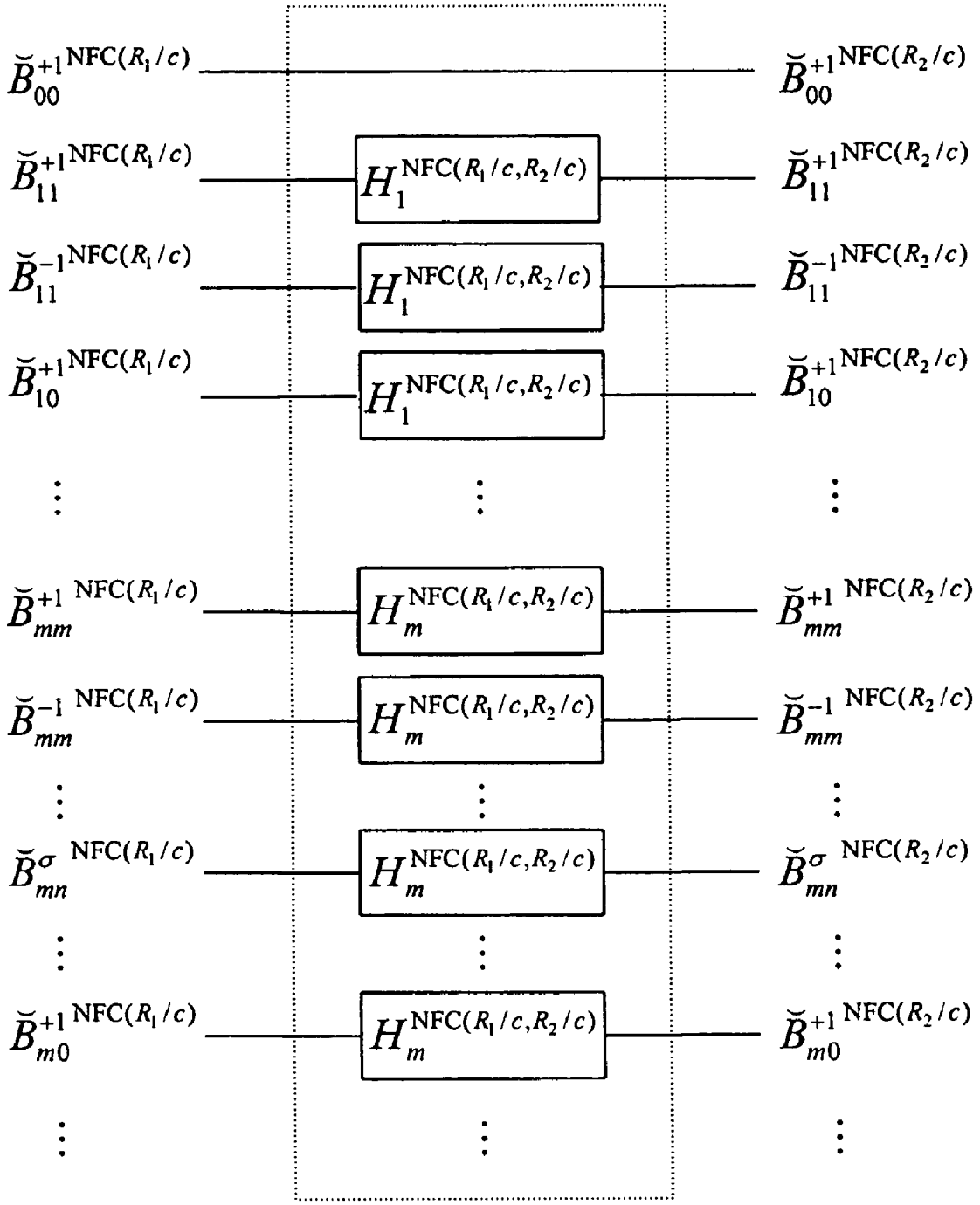
FIG. 12 diagrammatically represents a filtering module for adapting the ambisonic components received and pre-compensated to the encoding for a reference distance R as second distance, to a playback device comprising a plurality of loudspeakers disposed at a third distance $R_2$ from a point of auditory perception.

Referring to FIG. 12, the filtering module represented therein is provided for example in a processing unit of a playback device. The ambisonic components received have been pre-compensated on encoding for a reference distance $R_1$ as second distance. However, the playback device comprises a plurality of loudspeakers disposed at a third distance $R_2$ from a point of auditory perception P, this third distance $R_2$ being different from the aforesaid second distance $R_1$. The filtering module of FIG. 12, in the form $H_m^{NFC(R_1/c,R_2/c)}(\omega)$, then adapts, on reception of the data, the pre-compensation to the distance $R_1$ for a playback at the distance $R_2$. Of course, as indicated hereinabove, the playback device also receives the parameter $R_1/c$.

It should be noted that the invention furthermore makes it possible to mix several ambisonic representations of sound fields (real and/or virtual sources), whose reference distances R are different (as the case may be with infinite reference distances corresponding to far sources). Preferably, a pre-compensation of all these sources at the smallest reference distance will be filtered, before mixing the ambisonic signals, thereby making it possible to obtain correct definition of the sound relief on playback.

Within the framework of a so-called "sound focusing" processing with, on playback, a sound enrichment effect for a chosen direction in space (in the manner of a light projector illuminating in a chosen direction in optics), involving a matrix processing of sound focusing (with weighting of the ambisonic components), one advantageously applies the distance encoding with near field pre-compensation in a manner combined with the focusing processing.

In what follows, an ambisonic decoding method is described with compensation of the near field of loudspeakers, on playback.

To reconstruct an acoustic field encoded according to the ambisonic formalism, from the components $B_{mn}^{\sigma}$ and by using loudspeakers of a playback device which provides for an "ideal" placement of a listener which corresponds to the point of playback P of FIG. 7, the wave emitted by each loudspeaker is defined by a prior "re-encoding" processing of the ambisonic field at the center of the playback device, as follows.

In this "re-encoding" context, it is initially considered for simplicity that the sources emit in the far field.

Referring again to FIG. 7, the wave emitted by a loudspeaker of index i and of incidence ($\theta_i$ and $\delta_i$) is fed with a signal $S_i$. This loudspeaker participates in the reconstruction of the component $B'_{mn}$, through its contribution $S_i \cdot Y_{mn}^{\sigma}(\theta_i, \delta_i)$.

The vector $c_i$ of the encoding coefficients associated with the loudspeakers of index i is expressed by the relation:

$$c_i = \begin{bmatrix} Y_{00}^{+1}(\theta_i, \delta_i) \\ Y_{11}^{+1}(\theta_i, \delta_i) \\ Y_{11}^{-1}(\theta_i, \delta_i) \\ \dots \\ Y_{mn}^{\delta}(\theta_i, \delta_i) \\ \dots \end{bmatrix} \quad [B1]$$

The vector S of signals emanating from the set of N loudspeakers is given by the expression:

$$S = \begin{bmatrix} S_1 \\ S_2 \\ \dots \\ S_N \end{bmatrix} \quad [B2]$$

The encoding matrix for these N loudspeakers (which ultimately corresponds to a "re-encoding" matrix), is expressed by the relation:

$$C = [c_1 C_2 \dots C_N] \quad [B3]$$

where each term $c_i$ represents a vector according to the above relation [B1].

Thus, the reconstruction of the ambisonic field B' is defined by the relation:

$$\tilde{B} = \begin{bmatrix} B_{00}'^{+1} \\ B_{11}'^{+1} \\ B_{11}'^{-1} \\ \dots \\ B_{mn}'^{\sigma} \\ \dots \end{bmatrix} = C \cdot S \quad [B4]$$

Relation [B4] thus defines a re-encoding operation, prior to playback. Ultimately, the decoding, as such, consists in comparing the original ambisonic signals received by the playback device, in the form:

$$B = \begin{bmatrix} B_{00}^{+1} \\ B_{11}^{+1} \\ B_{11}^{-1} \\ \dots \\ B_{mn}^{\sigma} \\ \dots \end{bmatrix} \quad [B5]$$

with the re-encoded signals $\tilde{B}$, so as to define the general relation:

$$B'=B \quad [B6]$$

This involves, in particular, determining the coefficients of a decoding matrix D, which satisfies the relation:

$$S=D.B \quad [B7]$$

Preferably, the number of loudspeakers is greater than or equal to the number of ambisonic components to be decoded and the decoding matrix D may be expressed, as a function of the re-encoding matrix C, in the form:

$$D=C^T.(C.C^T)^{-1} \quad [B8]$$

where the notation $C^T$ corresponds to the transpose of the matrix C.

It should be noted that the definition of a decoding satisfying different criteria for each frequency band is possible, thereby making it possible to offer optimized playback as a function of the listening conditions, in particular as regards the constraint of positioning at the center O of the sphere of FIG. 3, during playback. For this purpose, provision is advantageously made for a simple filtering, by stepwise frequency equalization, at each ambisonic component.

However, to obtain a reconstruction of an originally encoded wave, it is necessary to correct the far field assumption for the loudspeakers, that is to say to express the effect of their near field in the re-encoding matrix C hereinabove and to invert this new system to define the decoder. For this purpose, assuming concentricity of the loudspeakers (disposed at one and the same distance R from the point P of FIG. 7), all the loudspeakers have the same near field effect $F_m^{((R/c)}(\omega)$, on each ambisonic component of the type $B'_{mn}{}^{\sigma}$. By introducing the near field terms in the form of a diagonal matrix, relation [B4] hereinabove becomes:

$$B'\mathrm{Diag}\,([1F_1^{R/c}(\omega)\,F_1^{R/c}(\omega)\dots F_m^{R/c}(\omega)\,F_m^{R/c}(\omega)\dots]).C.S \quad [B9]$$

Relation [B7] hereinabove becomes:

$$S = D\cdot\mathrm{Diag}\left(\left[1\ \frac{1}{F_1^{R/c}(\omega)}\ \frac{1}{F_1^{R/c}(\omega)}\ \cdots\ \frac{1}{F_m^{R/c}(\omega)}\ \frac{1}{F_m^{R/c}(\omega)}\ \cdots\right]\right)\cdot B \quad [B10]$$

Thus, the matrixing operation is preceded by a filtering operation which compensates the near field on each component $B_{mn}{}^{\sigma}$, and which may be implemented in digital form, as described hereinabove, with reference to relation [A14].

It will be recalled that in practice, the "re-encoding" matrix C is specific to the playback device. Its coefficients may be determined initially by parameterization and sound characterization of the playback device reacting to a predetermined excitation. The decoding matrix D is, likewise, specific to the playback device. Its coefficients may be determined by relation [B8]. Continuing with the previous notation where $\tilde{B}$ is the matrix of precompensated ambisonic components, these latter may be transmitted to the playback device in matrix form $\tilde{B}$ with:

$$\tilde{B} = \mathrm{Diag}\left(\left[1\ \frac{1}{F_1^{R/c}(\omega)}\ \frac{1}{F_1^{R/c}(\omega)}\ \cdots\ \frac{1}{F_m^{R/c}(\omega)}\ \frac{1}{F_m^{R/c}(\omega)}\ \cdots\right]\right)\cdot B$$

The playback device thereafter decodes the data received in matrix form $\tilde{B}$ (column vector of the components transmitted) by applying the decoding matrix D to the pre-compensated ambisonic components, so as to form the signals $S_i$ intended for feeding the loudspeakers $HP_i$, with:

$$S = \begin{pmatrix} S_1 \\ S_i \\ S_N \end{pmatrix} = D\cdot\tilde{B} \quad [B11]$$

Referring again to FIG. 12, if a decoding operation has to be adapted to a playback device of different radius $R_2$ from the reference distance $R_1$, a module for adaptation prior to the decoding proper and described hereinabove makes it possible to filter each ambisonic component $\tilde{B}_{mn}{}^{\sigma}$, so as to adapt it to a playback device of radius $R_2$. The decoding operation proper is performed thereafter, as described hereinabove, with reference to relation [B11].

An application of the invention to binaural synthesis is described hereinbelow.

Figure 13A:
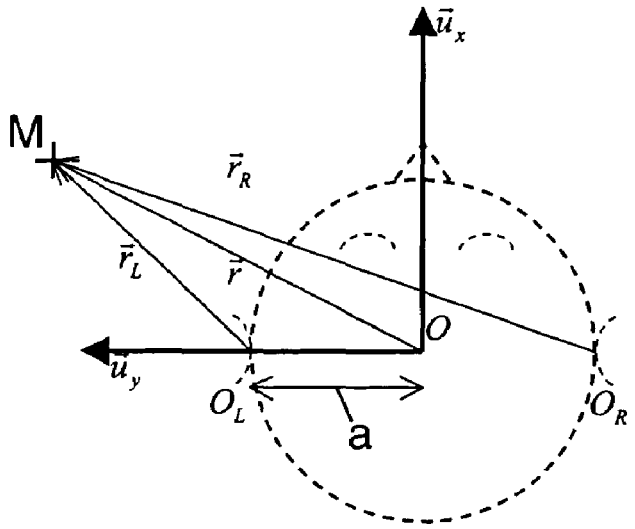
FIG. 13A diagrammatically represents the disposition of a sound source M, on playback, for a listener using a playback device applying a binaural synthesis, with a source emitting in the near field.

We refer to FIG. 13A in which a listener having a headset with two headphones of a binaural synthesis device is represented. The two ears of the listener are disposed at respective points $O_L$ (left ear) and $O_R$ (right ear) in space. The center of the listener's head is disposed at the point O and the radius of the listener's head is of value a. A sound source must be perceived in an auditory manner at a point M in space, situated at a distance r from the center of the listener's head (and respectively at distance $r_R$ from the right ear and $r_L$ from the left ear). Additionally, the direction of the source stationed at the point M is defined by the vectors $\vec{r}$, $\vec{r}_R$, and $\vec{r}_L$.

In a general manner, the binaural synthesis is defined as follows.

Each listener has his own specific shape of ear. The perception of a sound in space by this listener is done by learning, from birth, as a function of the shape of the ears (in particular the shape of the auricles and the dimensions of the head) specific to this listener. The perception of a sound in space is manifested inter alia by the fact that the sound reaches one ear before the other ear, this giving rise to a delay $\tau$ between the signals to be emitted by each headphone of the playback device applying the binaural synthesis.

The playback device is parameterized initially, for one and the same listener, by sweeping a sound source around his head, at one and the same distance R from the center of his head. It will thus be understood that this distance R may be considered to be a distance between a "point of playback" as stated hereinabove and a point of auditory perception (here the center O of the listener's head).

Figure 13B:
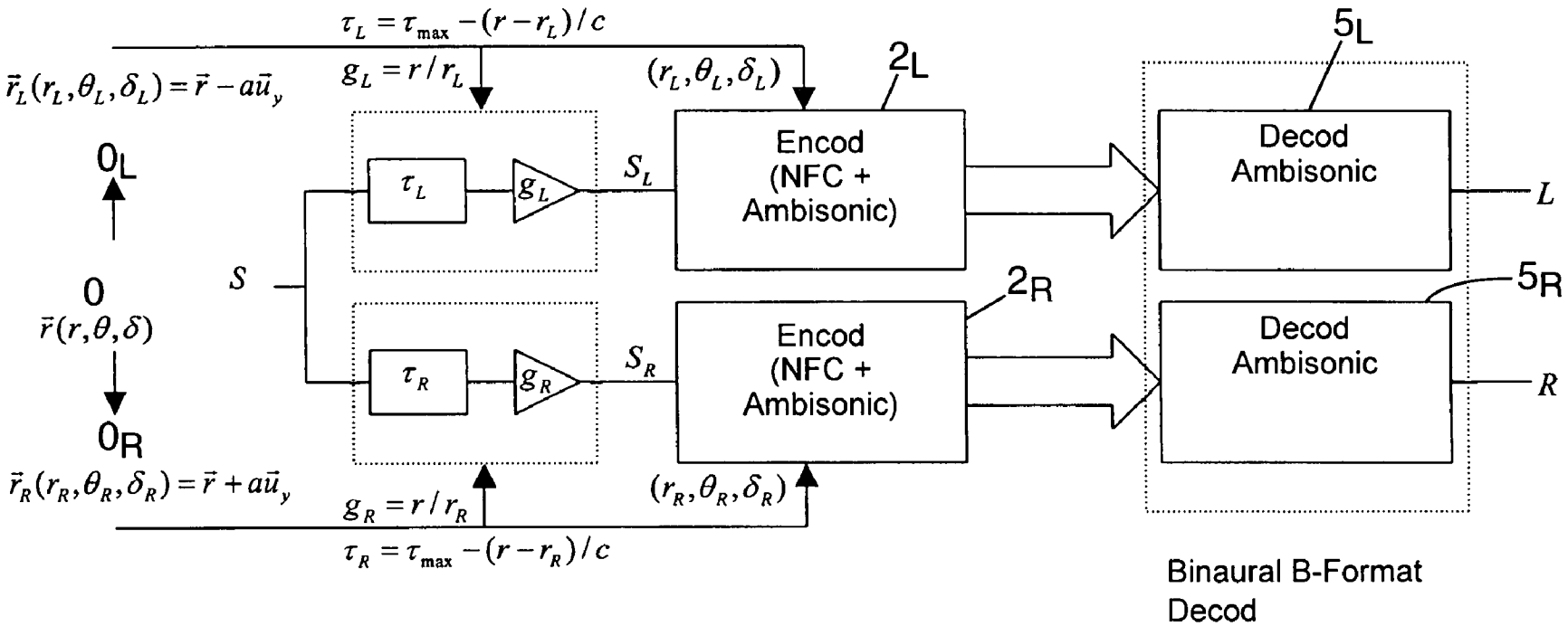
FIG. 13B diagrammatically represents the steps of encoding and of decoding with near field effect in the framework of the binaural synthesis of FIG. 13A with which an ambisonic encoding/decoding is combined.

In what follows, the index L is associated with the signal to be played back by the headphone adjoining the left ear and the index R is associated with the signal to be played back by the headphone adjoining the right ear. Referring to FIG. 13B, a delay can be applied to the initial signal S for each pathway intended to produce a signal for a distinct headphone. These delays $\tau_L$ and $\tau_R$ are dependent on a maximum delay $\tau_{MAX}$ which corresponds here to the ratio a/c where a, as indicated previously, corresponds to the radius of the listener's head and c to the speed of sound. In particular, these delays are defined as a function of the difference in distance from the point O. (center of the head) to the point M (position of the source whose sound is to be played back, in FIG. 13A) and from each ear to this point M. Advantageously, respective gains $g_L$ and $g_R$ are furthermore applied, to each pathway, which are dependent on a ratio of the distances from the point O to the point M and from each ear to the point M. Respective modules applied to each pathway $\mathbf{2}_L$ and $\mathbf{2}_R$ encode the signals of each pathway, in an ambisonic representation, with near field pre-compensation NFC (standing for "Near Field Compensation") within the sense of the present invention. It will thus be understood that, by the implementation of the method within the sense of the present invention, it is possible to define the signals arising from the source M, not only by their direction (azimuthal angles $\theta_L$ and $\theta_R$ and angles of elevation $\delta_L$ and $\delta_R$), but also as a function of the distance separating each ear $r_L$ and $r_R$ from the source M. The signals thus encoded are transmitted to the playback device comprising ambisonic decoding modules, for each pathway, $\mathbf{5}_L$ and $\mathbf{5}_R$ Thus, an ambisonic encoding/decoding is applied, with near field compensation, for each pathway (left headphone, right headphone) in the playback with binaural synthesis (here of "B-FORMAT" type), in duplicate form. The near field compensation is performed, for each pathway, with as first distance ρ a distance $r_L$ and $r_R$ between each ear and the position M of the sound source to be played back.

Described hereinbelow is an application of the compensation within the sense of the invention, within the context of sound acquisition in ambisonic representation.

Figure 14:
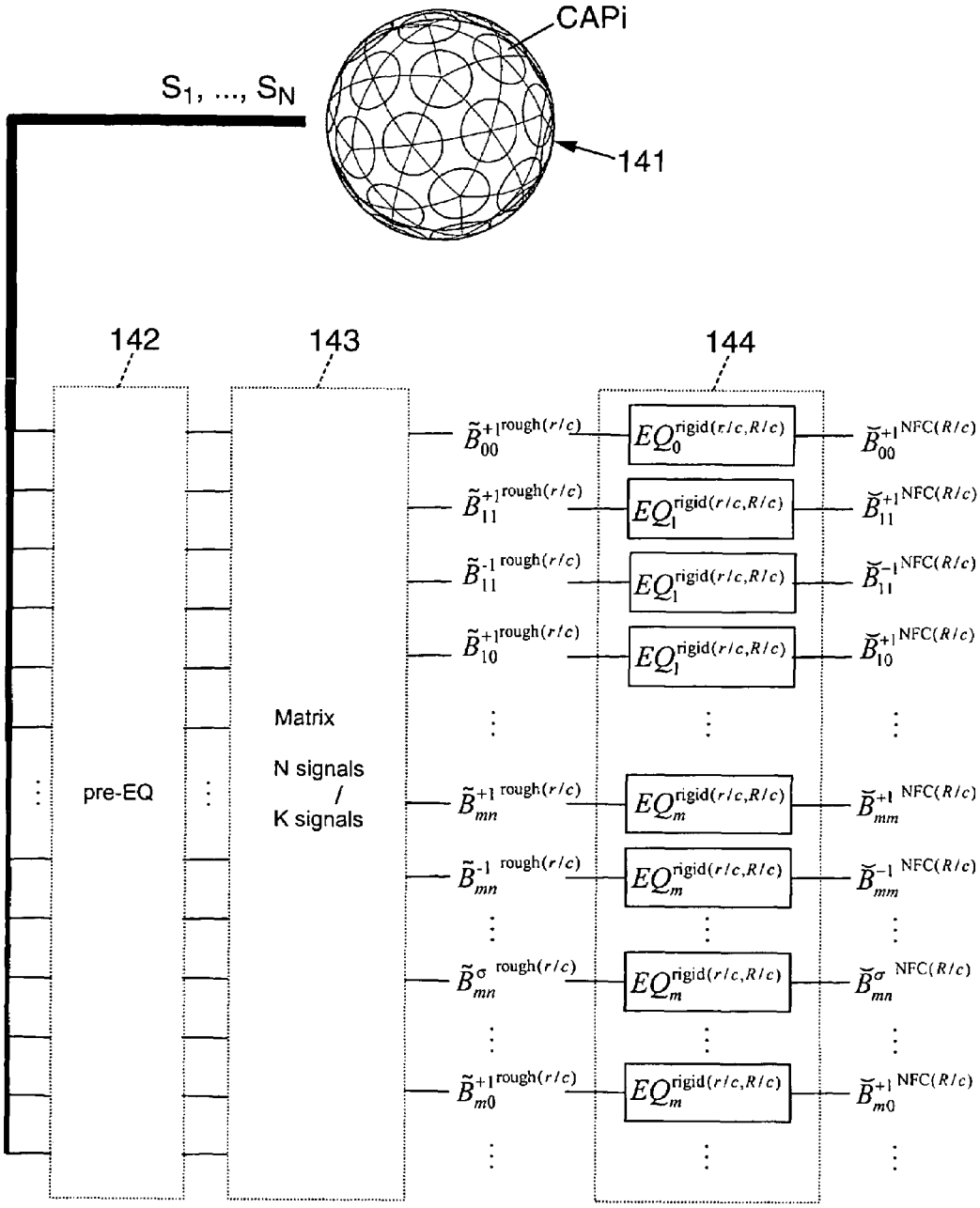
FIG. 14 diagrammatically represents the processing of the signals arising from a microphone comprising a plurality of pressure sensors arranged on a sphere, by way of illustration, by ambisonic encoding, equalization and near field compensation in the sense of the invention.

Reference is made to FIG. 14 in which a microphone 141 comprises a plurality of transducer capsules, capable of picking up acoustic pressures and reconstructing electrical signals $S_1, \ldots, S_N$. The capsules $CAP_i$ are arranged on a sphere of predetermined radius r (here, a rigid sphere, such as a ping-pong ball for example). The capsules are separated by a regular spacing over the sphere. In practice, the number N of capsules is chosen as a function of the desired order M of the ambisonic representation.

Indicated hereinbelow, within the context of a microphone comprising capsules arranged on a rigid sphere, is the manner of compensating for the near field effect, right from the encoding in the ambisonic context. It will thus be shown that the pre-compensation of the near field may be applied not only for virtual source simulation, as indicated hereinabove, but also upon acquisition and, in a more general manner, by combining the near field pre-compensation with all types of processing involving ambisonic representation.

In the presence of a rigid sphere (liable to introduce a diffraction of the sound waves received), relation [A1] given hereinabove becomes:

$$P_r(\bar{u}_i) = \sum_{m=0}^{\infty} \frac{j^{m-1}}{(kr)^2 h_m^{-\prime}(kr)} \sum_{\substack{0\le n\le m \\ \sigma=\pm 1}} B_{mn}^{\sigma} Y_{mn}^{\sigma}(\bar{u}_i). \quad [C1]$$

The derivatives of the spherical Hankel functions $h^-_m$ obey the recurrence law:

$$(2m+1)h_m^{-\prime}(x)=mh_{m-1}(x)-(m+1)h_{m+1}^-(x) \quad [C2]$$

We deduce the ambisonic components $B_{mn}^{\sigma}$ of the initial field from the pressure field at the surface of the sphere, by implementing projection and equalization operations given by relation:

$$B_{mn}^{\sigma}=EQ_m<p_r|Y_{mn}^{\sigma}>4\pi \quad [C3]$$

In this expression, $EQ_m$ is an equalizer filter which compensates for a weighting $W_m$ which is related to the directivity of the capsules and which furthermore includes the diffraction by the rigid sphere.

The expression for this filter $EQ_m$ is given by the following relation:

$$EQ_m = \frac{1}{W_m} = (kr)^2 h_m^{-\prime}(kr) j^{-m+1} \quad [C4]$$

The coefficients of this equalization filter are not stable and an infinite gain is obtained at very low frequencies. Moreover, it is appropriate to note that the spherical harmonic components, themselves, are not of finite amplitude when the sound field is not limited to a propagation of plane waves, that is to say ones which arise from far sources, as was seen previously.

Additionally, if, rather than providing capsules embedded in a solid sphere, provision is made for cardioid type capsules, with a far field directivity given by the expression:

$$G(\theta)=\alpha+(1-\alpha)\cos\theta \quad [C5]$$

By considering these capsules mounted on an "acoustically transparent" support, the weighting term to be compensated becomes:

$$W_m=j^m(\alpha jm(kr)-j(1-\alpha)jm'(kr)) \quad [C6]$$

It is again apparent that the coefficients of an equalization filter corresponding to the analytical inverse of this weighting given by relation [C6] are divergent for very low frequencies.

In general, it is indicated that for any type of directivity of sensors, the gain of the filter $EQ_m$ to compensate for the weighting $W_m$ related to the directivity of the sensors is infinite for low sound frequencies. Referring to FIG. 14, a near field pre-compensation is advantageously applied in the actual expression for the equalization filter $EQ_m$, given by the relation:

$$EQ_m^{NFC(R/c)}(\omega) = \frac{EQ_m(r,\omega)}{F_m^{(R/c)}(\omega)} \quad [C7]$$

Thus, the signals $S_1$ to $S_N$ are recovered from the microphone 141. As appropriate, a pre-equalization of these signals is applied by a processing module 142. The module 143 makes it possible to express these signals in the ambisonic context, in matrix form. The module 144 applies the filter of relation [C7] to the ambisonic components expressed as a function of the radius r of the sphere of the microphone 141. The near field compensation is performed for a reference distance R as second distance. The encoded signals thus filtered by the module 144 may be transmitted, as the case may be, with the parameter representative of the reference distance R/c.

Thus, it is apparent in the various embodiments related respectively to the creation of a near field virtual source, to the acquisition of sound signals arising from real sources, or even to playback (to compensate for a near field effect of the loudspeakers), that the near field compensation within the sense of the present invention may be applied to all types of processing involving an ambisonic representation. This near field compensation makes it possible to apply the ambisonic representation to a multiplicity of sound contexts where the direction of a source and advantageously its distance must be taken into account. Moreover, the possibility of the representation of sound phenomena of all types (near or far fields) within the ambisonic context is ensured by this pre-compensation, on account of the limitation to finite real values of the ambisonic components.

Of course, the present invention is not limited to the embodiment described hereinabove by way of example; it extends to other variants.

Thus, it will be understood that the near field pre-compensation may be integrated, on encoding, as much for a near source as for a far source. In the latter case (far source and reception of plane waves), the distance ρ expressed hereinabove will be considered to be infinite, without substantially modifying the expression for the filters $H_m$ which was given hereinabove. Thus, the processing using room effect processors which in general provide uncorrelated signals usable to model the late diffuse field (late reverberation) may be combined with near field pre-compensation. These signals may be considered to be of like energy and to correspond to a share of diffuse field corresponding to the omnidirectional component $W=B_{00}^{+1}$ (FIG. 4). The various spherical harmonic components (with a chosen order M) can then be constructed by applying a gain correction for each ambisonic component and a near field compensation of the loudspeakers is applied (with a reference distance R separating the loudspeakers from the point of auditory perception, as represented in FIG. 7).

Of course, the principle of encoding within the sense of the present invention is generalizable to radiation models other than monopolar sources (real or virtual) and/or loudspeakers. Specifically, any shape of radiation (in particular a source spread through space) may be expressed by integration of a continuous distribution of elementary point sources.

Furthermore, in the context of playback, it is possible to adapt the near field compensation to any playback context. For this purpose, provision may be made to calculate transfer functions (re-encoding of the near field spherical harmonic components for each loudspeaker, having regard to real propagation in the room where the sound is played back), as well as an inversion of this re-encoding to redefine the decoding.

Described hereinabove was a decoding method in which a matrix system involving the ambisonic components was applied. In a variant, provision may be made for a generalized processing by fast Fourier transforms (circular or spherical) to limit the computation times and the computing resources (in terms of memory) required for the decoding processing.

Figure 9:
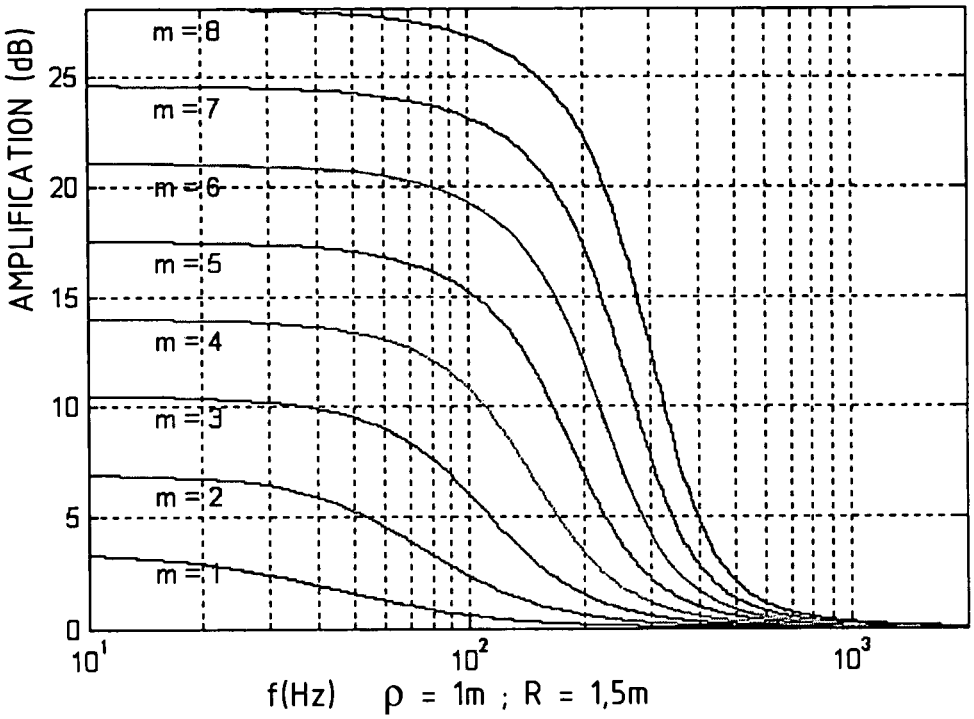
FIG. 9 represents energy spectra of the compensation and near field filters simulated for a first distance of a virtual source ρ=1 m and a pre-compensation of loudspeakers situated at a second distance R=1.5 m.
Figure 10:
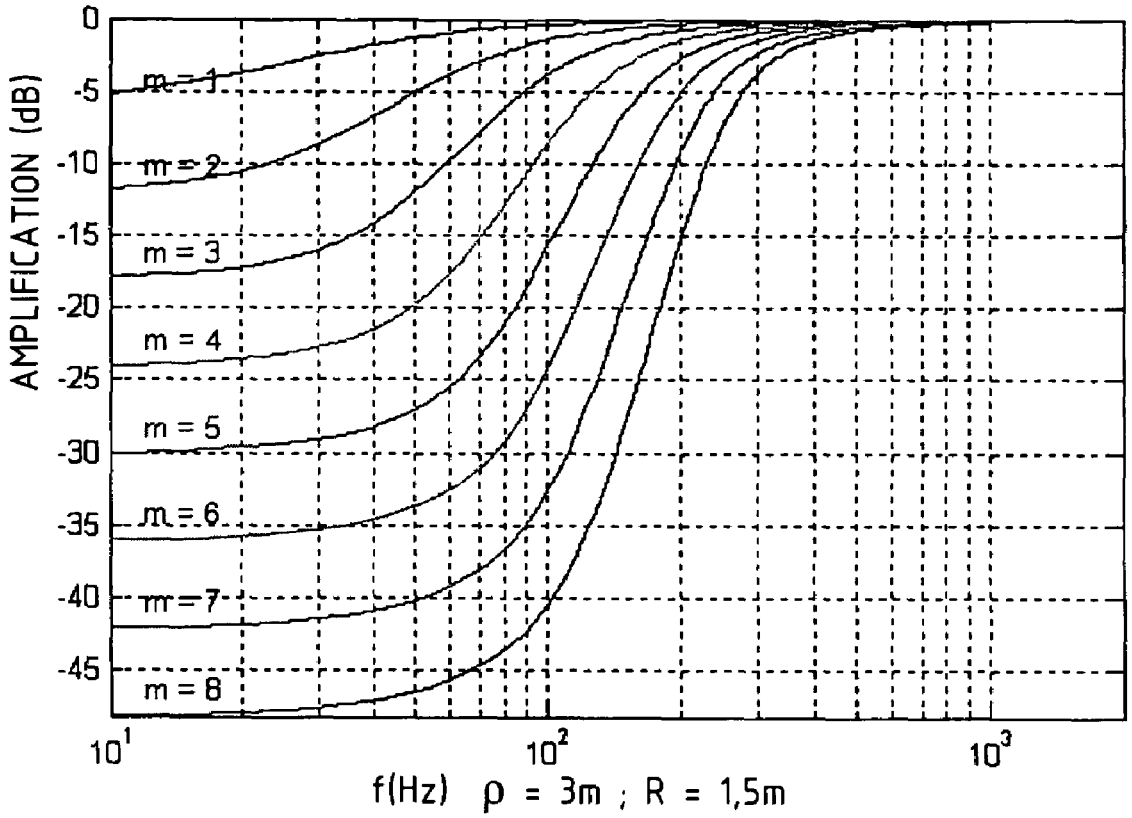
FIG. 10 represents energy spectra of the compensation and near field filters simulated for a first distance of the virtual source ρ=3 m and a pre-compensation of loudspeakers situated at a distance R=1.5 m.

As indicated hereinabove with reference to FIGS. 9 and 10, it is noted that the choice of a reference distance R with respect to the distance p of the near field source introduces a difference in gain for various values of the sound frequency. It is indicated that the method of encoding with pre-compensation may be coupled with audiodigital compression making it possible to quantize and adjust the gain for each frequency sub-band.

Advantageously, the present invention applies to all types of sound spatialization systems, in particular for applications of "virtual reality" type (navigation through virtual scenes in three-dimensional space, games with three-dimensional sound spatialization, conversations of "chat." type voiced over the Internet network), to sound rigging of interfaces, to audio editing software for recording, mixing and playing back music, but also to acquisition, based on the use of three-dimensional microphones, for musical or cinematographic sound capture, or else for the transmission of sound mood over the Internet, for example for sound-rigged "webcams".

The invention claimed is:

1. A method of processing sound data for playback by an ambisonic playback device, the method comprising:

a) encoding signals representative of at least one sound so as to obtain a representation of the at least one sound propagating in a three-dimensional space and arising from a source situated at a first distance from a reference point, the reference point corresponding to a point of auditory perception of the at least one sound, the encoded representation of the sound being by components expressed in a base of spherical harmonics, of origin corresponding to said reference point; and b) applying a compensation of a near field effect to said components by a filtering which is dependent on a second distance representing a distance between a playback point and a point of auditory perception of the encoded representation of the at least one sound, for a playback of the at least one sound by a playback device.

2. The method as claimed in claim 1, wherein, said source being far removed from the reference point:

components of successive orders m are obtained for the representation of the sound in said base of spherical harmonics, and a filter is applied, the coefficients of which, each applied to a component of order m, are expressed analytically in the form of the inverse of a polynomial of power m, whose variable is inversely proportional to the sound frequency and to said second distance, so as to compensate for a near field effect at the level of the playback device.

3. The method as claimed in claim 1, wherein, said source being a virtual source envisaged at said first distance:

components of successive orders m are obtained for the representation of the sound in said base of spherical harmonics, and a global filter is applied, the coefficients of which, each applied to a component of order m, are expressed analytically in the form of a fraction, in which:

the numerator is a polynomial of power m, whose variable is inversely proportional to the sound frequency and to said first distance, so as to simulate a near field effect of the virtual source, and the denominator is a polynomial of power m, whose variable is inversely proportional to the sound frequency and to said second distance, so as to compensate for the effect of the near field of the virtual source in the low sound frequencies.

4. The method as claimed in claim 1, wherein the data coded and filtered in steps a) and b) are transmitted to the playback device with a parameter representative of said second distance.

5. The method as claimed in claim 1 wherein, the data coded and filtered in steps a) and b) are stored with a parameter representative of said second distance on a memory medium intended to be read by the playback device.

6. The method as claimed in claim 4, in which, prior to a sound playback by a playback device comprising a plurality of loudspeakers disposed at a third distance from said point of auditory perception, an adaptation filter whose coefficients are dependent on said second and third distances is applied to the coded and filtered data.

7. The method as claimed in claim 6, wherein the coefficients of said adaptation filter, each applied to a component of order m, are expressed analytically in the form of a fraction, in which:

the numerator is a polynomial of power m, whose variable is inversely proportional to the sound frequency and to said second distance, and the denominator is a polynomial of power m, whose variable is inversely proportional to the sound frequency and to said third distance.

8. The method as claimed in claim 2, wherein, for the implementation of step b), there is provided:

in respect of the components of even order m, audiodigital filters in the form of a cascade of cells of order two; and in respect of the components of odd order m, audiodigital filters in the form of a cascade of cells of order two and an additional cell of order one.

9. The method as claimed in claim 8, wherein the coefficients of an audiodigital filter, for a component of order m, are defined from the numerical values of the roots of said polynomials of power m.

10. The method as claimed in claim 2, wherein said polynomials are Bessel polynomials.

11. The method as claimed in claim 1, wherein there is provided a microphone comprising an array of acoustic transducers arranged substantially on the surface of a sphere whose center corresponds substantially to said reference point, so as to obtain said signals representative of at least one sound propagating in the three-dimensional space.

12. The method as claimed in claim 11, wherein a global filter is applied in step b) so as, on the one hand, to compensate for a near field effect as a function of said second distance and, on the other hand, to equalize the signals arising from the transducers so as to compensate for a weighting of directivity of said transducers.

13. The method as claimed in claim 11 wherein there is provided a number of transducers that depends on a total number of components chosen to represent the sound in said base of spherical harmonics.

14. The method as claimed in claim 1, in which in step a) a total number of components is chosen from the base of spherical harmonics so as to obtain, on playback, a region of the space around the point of perception in which the playback of the sound is faithful and whose dimensions are increasing with the total number of components.

15. The method as claimed in claim 14, wherein there is provided a playback device comprising a number of loudspeakers at least equal to said total number of components.

16. The method as claimed in claim 1, wherein:

there is provided a playback device comprising at least a first and a second loudspeaker disposed at a chosen distance from a listener, a cue of awareness of the position in space of sound sources situated at a predetermined reference distance from the listener is obtained for this listener, and the compensation of step b) is applied with said reference distance substantially as second distance.

17. The method as claimed in claim 4, wherein:

there is provided a playback device comprising at least a first and a second loudspeaker disposed at a chosen distance from a listener, a cue of awareness of the position in space of sound sources situated at a predetermined reference distance from the listener is obtained for this listener, and prior to a sound playback by the playback device, an adaptation filter whose coefficients are dependent on the second distance and substantially on the reference distance, is applied to the data coded and filtered in steps a) and b).

18. The method as claimed in claim 16, wherein:

the playback device comprises a headset with two headphones for the respective ears of the listener, and separately for each headphone, the coding and the filtering of steps a) and b) are applied with regard to respective signals intended to be fed to each headphone, with, as first distance, respectively a distance separating each ear from a position of a source to be played back.

19. The method as claimed in claim 1, wherein a matrix system is fashioned, in steps a) and b), said system comprising at least:

a matrix comprising said components in the base of spherical harmonics, and a diagonal matrix whose coefficients correspond to filtering coefficients of step b), and said matrices are multiplied to obtain a result matrix of compensated components.

20. The method as claimed in claim 19, wherein:

the playback device comprises a plurality of loudspeakers disposed substantially at one and the same distance from the point of auditory perception, and to decode said data coded and filtered in steps a) and b) and to form signals suitable for feeding said loudspeakers:

a matrix system is formed comprising said result matrix and a predetermined decoding matrix, specific to the playback device, and a matrix is obtained comprising coefficients representative of the loudspeakers feed signals by multiplication of the matrix of the compensated components by said decoding matrix.

21. A sound acquisition device, comprising a microphone furnished with an array of acoustic transducers disposed substantially on the surface of a sphere, wherein the device furthermore comprises a processing unit arranged so as to:

receive signals each emanating from a transducer responsive to a sound, apply a coding to said signals so as to obtain a representation of the sound by components expressed in a base of spherical harmonics, of origin corresponding to the center of said sphere, and apply a filtering to said components, which filtering is dependent, on the one hand, on a distance corresponding to the radius of the sphere and, on the other hand, on a reference distance corresponding to a distance between a playback point and a point of auditory perception.

22. The device as claimed in claim 21, wherein said filtering consists, on the one hand, in equalizing, as a function of the radius of the sphere, the signals arising from the transducers so as to compensate for a weighting of directivity of said transducers and, on the other hand, in compensating for a near field effect as a function of a chosen reference distance, defining substantially, for a playback of the sound, a distance between a playback point and a point of auditory perception.

23. A method of processing sound data for playback by an ambisonic playback device, the method comprising:

a) encoding signals representative of at least one sound so as to obtain a representation of the at least one sound propagating in a three-dimensional space and arising from a source situated at a first distance from a reference point, the reference point corresponding to a point of auditory perception of the at least one sound, the encoded-representation of the sound being by components expressed in a base of spherical harmonics, of origin corresponding to said reference point; and b) applying a compensation of a near field effect to said components by a filtering which is dependent on a second distance representing a distance between a playback point and a point of auditory perception of the encoded representation of the at least one sound, for a playback of the at least one sound by a playback device, wherein said filtering applies filter coefficients expressed analytically in the form of a fraction, in which the denominator is inversely proportional to the sound frequency and to said second distance, so as to compensate for said near field effect.

24. The method of claim 23, wherein the representation of the at least one sound propagating in a three-dimensional space is an ambisonic representation.

25. The method of claim 1, wherein the representation of the at least one sound propagating in a three-dimensional space is an ambisonic representation.

26. The method of claim 21, wherein the representation of the at least one sound propagating in a three-dimensional space is an ambisonic representation.

* * * * *